US010699646B2

(12) United States Patent
Kim

(10) Patent No.: US 10,699,646 B2
(45) Date of Patent: Jun. 30, 2020

(54) DATA DRIVER AND ORGANIC LIGHT-EMITTING DISPLAY DEVICE USING THE SAME

(71) Applicant: LG Display Co., Ltd., Seoul (KR)

(72) Inventor: Jihun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/213,608

(22) Filed: Dec. 7, 2018

(65) Prior Publication Data

US 2019/0180693 A1 Jun. 13, 2019

(30) Foreign Application Priority Data

Dec. 11, 2017 (KR) ..... 10-2017-0169697

(51) Int. Cl.

| | |
|---|---|
| ***G09G 3/36*** | (2006.01) |
| ***G09G 3/3275*** | (2016.01) |
| *G09G 3/3233* | (2016.01) |
| *G09G 3/3266* | (2016.01) |

(52) U.S. Cl.

CPC ..... *G09G 3/3275* (2013.01); *G09G 3/3233* (2013.01); *G09G 3/3266* (2013.01); *G09G 2300/0465* (2013.01); *G09G 2300/0809* (2013.01); *G09G 2310/0291* (2013.01); *G09G 2310/0294* (2013.01); *G09G 2310/08* (2013.01); *G09G 2320/0295* (2013.01)

(58) Field of Classification Search

CPC ..... G09G 2310/0264; G09G 3/3208–3291
USPC ..... 345/100
See application file for complete search history.

(56) References Cited

U.S. PATENT DOCUMENTS

| | | | | |
|---|---|---|---|---|
| 2010/0295832 | A1* | 11/2010 | Nishio | G06F 3/0421 345/207 |
| 2013/0050292 | A1* | 2/2013 | Mizukoshi | G09G 3/3291 345/690 |
| 2016/0104428 | A1* | 4/2016 | In | G09G 3/3275 345/214 |
| 2017/0132977 | A1* | 5/2017 | Kim | G09G 3/3225 |
| 2017/0352305 | A1* | 12/2017 | Chang | G09G 3/3275 |

* cited by examiner

*Primary Examiner* — Roy P Rabindranath
(74) *Attorney, Agent, or Firm* — Fenwick & West LLP

(57) ABSTRACT

A data driver and an organic light-emitting display device using the same. The data driver includes a first amplifier, a sample/hold circuit, a first switch circuit, and a second switch circuit. The first switch circuit selectively connects a driving initialization voltage and a sensing initialization voltage to a first data line and a second data line. The second switch circuit selectively connects the first amplifier to the first data line and the second data line and selectively connecting the sample/hold circuit to the first data line and the second data line.

22 Claims, 13 Drawing Sheets

DATA DRIVER AND ORGANIC LIGHT-EMITTING DISPLAY DEVICE USING THE SAME

CROSS REFERENCE TO RELATED APPLICATION

This application claims priority to Republic of Korea Patent Application No. 10-2017-0169697, filed on Dec. 11, 2017, which is incorporated by reference in its entirety.

BACKGROUND

Field

The present disclosure relates to a data driver and an organic light-emitting display device using the same.

Description of Related Art

In response to the development of the information society, demand for a variety of types of display devices for displaying images is increasing. A range of display devices, such as liquid crystal display (LCD) devices, plasma display panel (PDP) devices, and organic light-emitting display devices, have recently come into widespread use.

Among such display devices, organic light-emitting display devices have recently come into prominence, since they are self-emissive display devices, have superior properties, such as rapid response speeds, wide viewing angles, and excellent color reproducibility, and can be provided with a thin profile.

Recently, high resolution and/or a large area is required for organic light-emitting display devices. In an organic light-emitting display device having high resolution and/or a large area, when the number of channels, through which a gate driver and a data driver output gate signals and data signals, is increased, fabrication costs of the gate driver and/or the data driver are increased, thereby increasing fabrication costs of the organic light-emitting display device. In addition, in consideration of an aesthetic aspect of the design, bezels of display devices tend to be narrower. An increase in the number of channels, through which the gate driver and the data driver output gate signals and data signals, may result in complex electrical lines between the display panel and the gate driver and/or between the display panel and the data driver, which is problematic. In addition, when the sizes of the gate driver and the data driver are increased due to the increased number of channels, it may be difficult to provide a narrow bezel.

In addition, an organic light-emitting display device having a high aperture ratio can advantageously emit high-luminance light, thereby reducing power consumption. Accordingly, a solution able to improve the aperture ratio is demanded.

SUMMARY

Various aspects of the present disclosure provide a data driver able to reduce fabrication costs and an organic light-emitting display device using the same.

Also provided is an organic light-emitting display device having high resolution and/or a large area, by which a bezel area can be reduced and an aperture ratio can be increased.

According to an aspect of the present disclosure, a data driver may include: a first amplifier; a sample/hold circuit; a first switch circuit selectively connecting a driving initialization voltage and a sensing initialization voltage to a first data line and a second data line; and a second switch circuit selectively connecting the first amplifier to the first data line and the second data line and selectively connecting the sample/hold circuit to the first data line and the second data line.

According to another aspect of the present disclosure, a data driver may include: a first amplifier supplying a data signal through a first data line in a first driving time, supplying the data signal through a second data line in a second driving time, supplying the data signal through the first data line in a first sensing time, and supplying the data signal through the second data line in a second sensing time; and a sample/hold circuit receiving a sensing voltage through the second data line in the first sensing time and receiving the sensing voltage through the first data line in the second sensing time.

According to another aspect of the present disclosure, an organic light-emitting display device may include: a first pixel receiving a data signal through a first data line and an initialization voltage through a second data line; a second pixel receiving the data signal through the second data line and the initialization voltage through the first data line; the first data line extending in a first direction; the second data line extending parallel and adjacently to the first data line; and first and second gate lines extending in a second direction, adjacently to each other, wherein the first gate line allowing a gate signal to be applied to the first pixel therethrough, and the second gate line allowing the gate signal to be applied to the second pixel therethrough.

According to exemplary embodiments, it is possible to provide a data driver able to reduce fabrication costs and an organic light-emitting display device using the same.

In addition, it is possible to provide an organic light-emitting display device having high resolution and/or a large area, by which a bezel area can be reduced and an aperture ratio can be increased.

BRIEF DESCRIPTION OF THE DRAWINGS

The above and other objects, features, and advantages of the present disclosure will be more clearly understood from the following detailed description when taken in conjunction with the accompanying drawings, in which.

DETAILED DESCRIPTION

Figure 1:
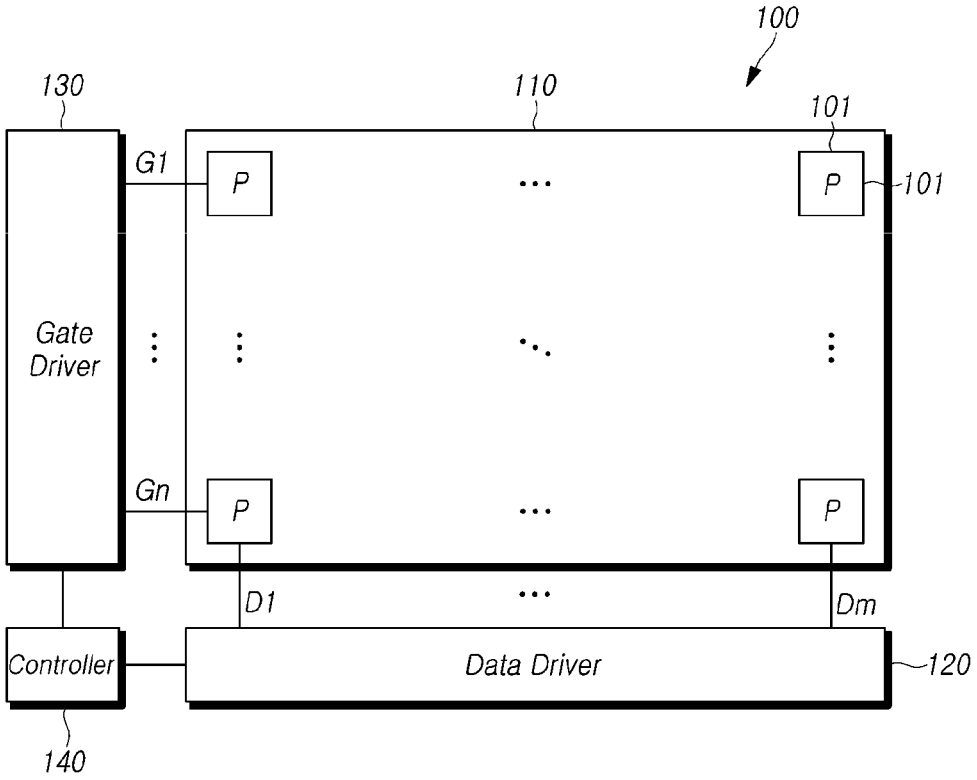
FIG. 1 is a block diagram illustrating an exemplary configuration of an organic light-emitting display device according to exemplary embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are merely used to distinguish one element from other elements. The substance, sequence, order, or number of such elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element.

FIG. 1 is a block diagram illustrating an exemplary configuration of an organic light-emitting display device according to exemplary embodiments.

Referring to FIG. 1, the organic light-emitting display device 100 may include a display panel 110, a data driver 120, a gate driver 130, and a controller 140.

The display panel 110 may include a plurality of pixels 101. The plurality of pixels 101 may be driven by data signals and gate signals applied thereto and, in response to data voltage levels of the data signals, express grayscale levels. Each of the plurality of pixels 101 may emit red, blue, and green light. However, colors of light emitted by the plurality of pixels 101 are not limited thereto.

Data lines D1, . . . , and Dm, through which data signals are transferred to the plurality of pixels 101, and gate lines G1, . . . , and Gn, through which gate signals are transferred to the plurality of pixels 101, may be disposed on the display panel 110. The data lines D1 . . . and Dm may intersect the gate lines G1 . . . and Gn. The plurality of pixels 101 may be connected to the data lines D1 . . . and Dm and the gate lines G1 . . . and Gn. Electrical lines disposed on the display panel 110 are not limited to the data lines D1 . . . and Dm and the gate lines G1 . . . and Gn.

The data driver 120 may transfer data signals to the data lines D1 . . . and Dm. Data signals, output from the data driver 120, may be analog data signals. The analog data signals may be data voltages corresponding to grayscale levels. The data driver 120 may include a plurality of driver integrated circuits (ICs). The number of driver ICs of the data driver 120 may be determined depending on the resolution of the display panel 110.

The gate driver 130 can allow a gate signal to be sequentially driven to the gate lines G1 . . . and Gn. Although the gate driver 130 is illustrated as a component separate from the display panel 110, the present disclosure is not limited thereto. The gate driver may be provided as a gate-in-panel (GIP) circuit, disposed in a specific area of the display panel 110. Although the gate driver 130 is illustrated as being disposed on one side of the display panel 110, the present disclosure is not limited thereto. The gate driver 130 may include a plurality of driver ICs.

The data driver 120 and the gate driver 130 may be connected to the display panel 110 via a printed circuit board (PCB).

The controller 140 may output control signals to control the data driver 120 and the gate driver 130. The controller 140 may transfer digital data signals to the data driver 120. The controller 140 may receive image signals from an external source, convert the image signals into digital data signals, and transfer the digital data signals to the data driver 120.

Figure 2:
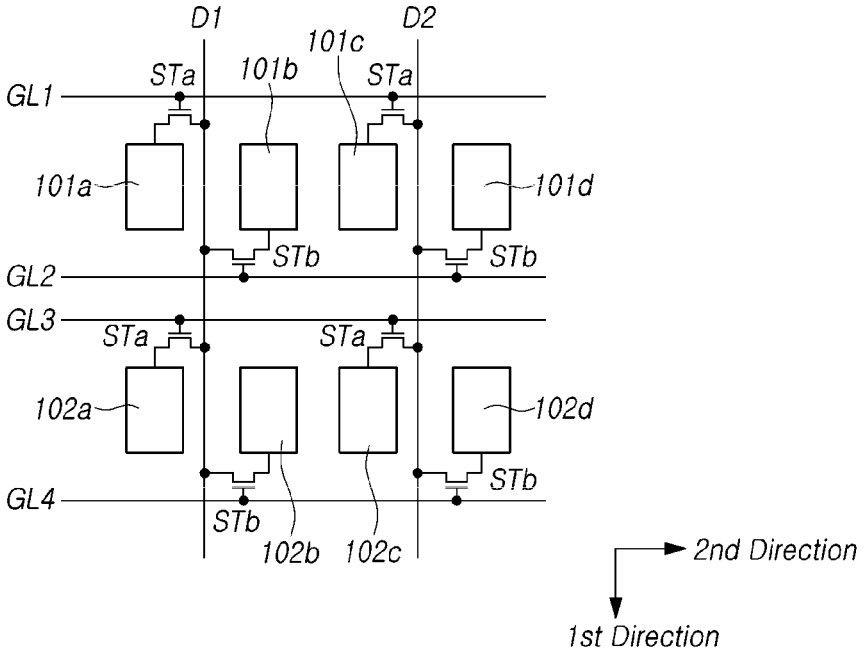
FIG. 2 is a conceptual view illustrating an embodiment of driving of the organic light-emitting display device.

FIG. 2 is a conceptual view illustrating an embodiment of driving of the organic light-emitting display device.

Referring to FIG. 2, in the display panel 110, a first data line D1 and a second data line D2 extend parallel to each other in a first direction, while first to fourth gate lines GL1 to GL4 extend parallel to each other in a second direction. In addition, the second and third gate lines GL2 and GL3 among the first to fourth gate lines GL1 to GL4 may be disposed adjacently to each other. The second and third gate lines GL2 and GL3 being adjacent to each other may mean a pixel is not disposed between the second and third gate lines GL2 and GL3. However, the present disclosure is not limited thereto.

A switching transistor STa of a first pixel 101*a* may be connected to the first data line D1 and the first gate line GL1. A switching transistor STb of a second pixel 101*b* may be connected to the first data line D1 and the second gate line GL2. A switching transistor STa of a third pixel 101*c* may be connected to the second data line D2 and the first gate line GL1. A switching transistor STb of a fourth pixel 101*d* may be connected to the second data line D2 and the second gate line GL2.

A switching transistor STa of a fifth pixel 102*a* may be connected to the first data line D1 and the third gate line GL3. A switching transistor STb of a sixth pixel 102*b* may be connected to the first data line D1 and the fourth gate line GL4. A switching transistor STa of a seventh pixel 102*c* may be connected to the second data line D2 and the third gate line GL3. A switching transistor STb of an eighth pixel 102*d* may be connected to the second data line D2 and the fourth gate line GL4.

Although the display panel 110 is illustrated as including a plurality of pixels arranged in a 2×4 matrix, this is only an illustrative example and the present disclosure is not limited thereto.

For example, in the display panel 110 including the plurality of pixels arranged as described above, data signals may be supplied to the pixels such that data signals can be supplied to the first pixel 101*a* and the second pixel 101*b* at different points in time. More particularly, during a first horizontal time Hsync, data signals may be supplied to the data lines D1, . . . , and D2 twice, and a first gate signal and a second gate signal may sequentially be applied to the first gate line GL1 and the second gate line GL2. A method of driving the display panel 110 in this manner may be referred to as a double rate driving (DRD) method.

When the organic light-emitting display device 100 is driven using the DRD method, the number of the data lines D1 . . . and Dn disposed on the display panel 110 may be reduced. When the number of the data lines D1 . . . and Dn is reduced, a data driver having a smaller number of channels, through which data signals are output, can be used. Accordingly, the data driver 120 used in the display panel 110 may have a smaller number of channels, through which data signals are output, compared to the resolution of the display panel 110. In addition, when the data driver 120 uses a plurality of driver ICs, the number of the driver ICs can be reduced. However, this may increase both the number of gate lines disposed on the display panel 110 and fabrication costs of the gate driver 130, which are problematic. This may consequently increase fabrication costs of the organic light-emitting display device 100. In addition, it may be difficult to provide a narrow bezel, due to an increase in the number of electrical lines between the gate driver 130 and the display panel 110.

Figure 3:
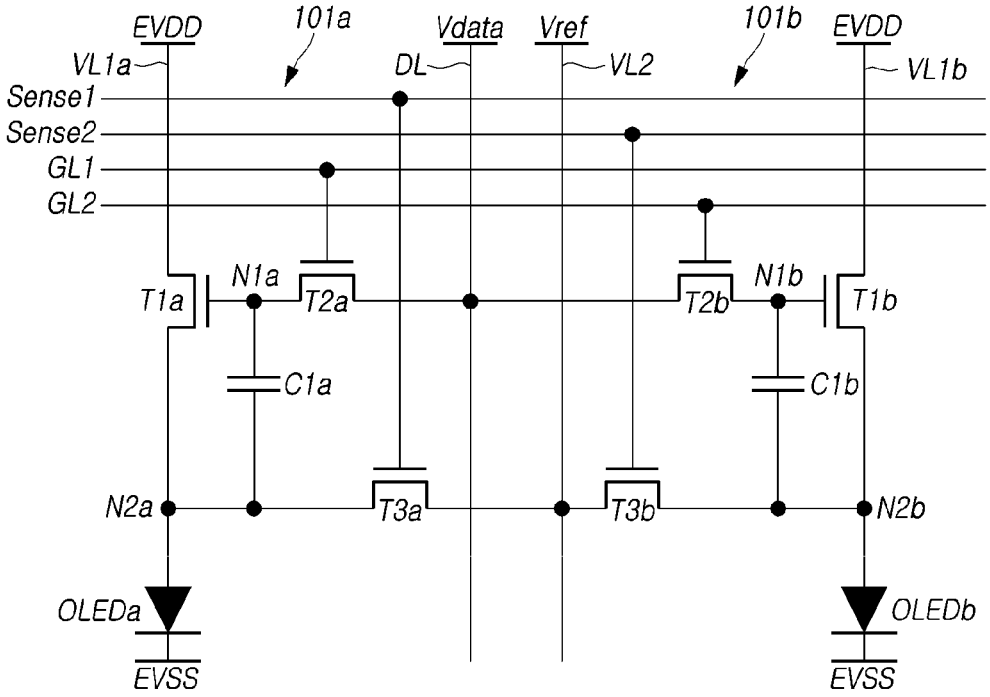
FIG. 3 is a circuit diagram illustrating an exemplary display panel including pixels in the organic light-emitting display device according to exemplary embodiments.

FIG. 3 is a circuit diagram illustrating an exemplary display panel including pixels in the organic light-emitting display device according to exemplary embodiments.

Referring to FIG. 3, a first pixel 101*a* may include an organic light-emitting diode OLEDa and a pixel circuit including first to third transistors T1*a* to T3*a* and a capacitor C1*a*. A second pixel 101*b* may include an organic light-emitting diode OLEDb and a pixel circuit including first to third transistors T1*b* to T3*b* and a capacitor C1*b*. The first transistors T1*a* and T1*b* may be driving transistors supplying driving current to the organic light-emitting diodes OLEDa and OLEDb. In addition, the second transistors T2*a* and T2*b* may correspond to the switching transistors STa and STb illustrated in FIG. 2.

In the first pixel 101*a*, the first transistor T1*a* may have a gate electrode connected to a first node N1*a*, a first electrode connected to a first voltage line VL1*a*, through which a first voltage EVDD is supplied, and a second electrode connected to a second node N2*a*. The second transistor T2*a* may have a gate electrode connected to the gate line GL1, a first electrode connected to a data line DL, through which a data voltage Vdata is supplied, and a second electrode connected to the first node N1*a*. The third transistor T3*a* may have a gate electrode connected to a first sensing line Sense1, a first electrode connected to the second node N2*a*, and a second electrode connected to a second voltage line VL2, through which a reference voltage Vref is transferred. The first capacitor C1*a* may have a first electrode connected to the first node N1*a* and a second electrode disposed between the second node N2*a* and the third transistor T3*a*. In addition, the organic light-emitting diode OLEDa may have an anode connected to the second node N2*a* and a cathode to which a second voltage EVSS is transferred.

In the second pixel 101*b*, the first transistor T1*b* may have a gate electrode connected to a first node N1*b*, a first electrode connected to a first voltage line VL1*b*, through which a first voltage EVDD is supplied, and a second electrode connected to a second node N2*b*. The second transistor T2*b* may have a gate electrode connected to the gate line GL2, a first electrode connected to the data line DL, through which the data voltage Vdata is supplied, and a second electrode connected to the first node N1*b*. The third transistor T3*b* may have a gate electrode connected to a second sensing line Sense2, a first electrode connected to the second node N2*b*, and a second electrode connected to the second voltage line VL2, through which the reference voltage Vref is transferred. The first capacitor C1*b* may have a first electrode connected to the first node N1*b* and a second electrode disposed between the second node N2*b* and the third transistor T3*b*. In addition, the organic light-emitting diode OLEDb may have an anode connected to the second node N2*b* and a cathode to which a second voltage EVSS is transferred.

The reference voltage Vref, transferred through the second voltage line VL2, may be one of a sensing voltage Vsense and an initialization voltage Vinit. The sensing voltage Vsense and the initialization voltage Vinit may be transferred through the second voltage line VL2 at different points in time. The sensing voltage Vsense may be a voltage that is already applied to the second voltage line VL2 at a specific point in time (i.e. a sensing time).

While the pixels 101*a* and 101*b* configured as above share a single data line DL, two gate lines GL1 and GL2 and two sensing lines Sense1 and Sense2 are necessary. This accordingly increases the size of the gate driver 130 transferring gate signals and sensing signals, which is problematic. The increased size of the gate driver 130 may disadvantageously increase a bezel area. In addition, the number of the gate lines and the number of the sensing lines, disposed on the display panel 110, may also be increased, thereby lowering the aperture ratio of the display panel 110, which is problematic.

Figure 4:
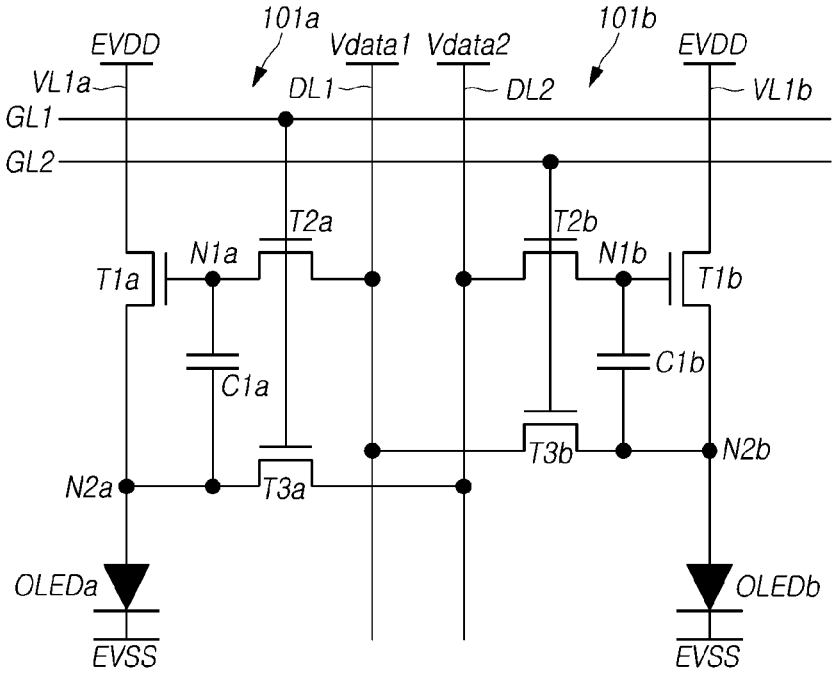
FIG. 4 is a circuit diagram illustrating an embodiment of pixels used in the organic light-emitting display device according to exemplary embodiments.

FIG. 4 is a circuit diagram illustrating an embodiment of pixels used in the organic light-emitting display device according to exemplary embodiments.

Referring to FIG. 4, in a first pixel 101*a*, a first transistor T1*a* may have a gate electrode connected to a first node N1*a*, a first electrode connected to a first voltage line VL1*a*, through which a first voltage EVDD is transferred, and a second electrode connected to a second node N2*a*. A second transistor T2*a* may have a gate electrode connected to a first gate line GL1, a first electrode connected to a first data line DL1, and a second electrode connected to the first node N1*a*. A third transistor T3*a* may have a gate electrode connected to the first gate line GL1, a first electrode connected to a second data line DL2, and a second electrode connected to the second node N2*a*. A first capacitor C1*a* may be disposed between the first node N1*a* and the second node N2*a*. In addition, an organic light-emitting diode OLEDa may have an anode connected to the second node N2*a* and a cathode to which a second voltage EVSS is transferred.

In a second pixel 101*b*, a first transistor T1*b* may have a gate electrode connected to a first node N1*b*, a first electrode connected to a first voltage line VL1*b*, and a second electrode connected to a second node N2*b*. A second transistor T2*b* may have a gate electrode connected to a second gate line GL2, a first electrode connected to the second data line DL2, and a second electrode connected to the first node N1*a*. A third transistor T3*b* may have a gate electrode connected to the second gate line GL2, a first electrode connected to the first data line DL1, and a second electrode connected to the second node N2*b*. A first capacitor C1*b* may be disposed between the first node N1*b* and the second node N2*b*. In addition, an organic light-emitting diode OLEDb may have an anode connected to the second node N2*b* and a cathode to which a second voltage EVSS is transferred.

In the case in which the pixels 101*a* and 101*b* are disposed on the display panel 110 as described above, no sensing signals are necessary, unlike in case of the pixels illustrated in FIG. 3. Since the gate driver 130 is not required to output sensing signals, the number of channels can be reduced, thereby reducing the size of the gate driver 130. In addition, when the gate driver 130 includes a plurality of driver ICs, the number of the driver ICs can also be reduced. Accordingly, fabrication costs of the organic light-emitting display device can be reduced. In addition, since the size of the gate driver 130 is reduced and the number of the driver ICs is reduced, the size of the bezel area of the display device 100 can be reduced. Furthermore, since no sensing signals are output, it is unnecessary to dispose the sensing lines Sense1 and Sense2 on the display panel 110. This can accordingly increase the aperture ratio of the display panel 110.

In addition, the organic light-emitting display device 100 is configured to sense the threshold voltage, mobility, and the like of the first transistors T1*a* and T1*b* and the organic light-emitting diodes OLEDa and OLEDb and correct data signals. This can accordingly improve image quality and compensate for degradations, thereby increasing the longevity of the organic light-emitting display device 100. In this regard, the display panel 110 illustrated in FIG. 3 can obtain information regarding a threshold voltage, mobility, and the like by sensing voltages of the second nodes N2*a* and N2*b* via the second voltage line VL2.

In contrast, when the pixels, as illustrated in FIG. 4, are disposed on the display panel 110, the second voltage line VL2 may not be necessary.

Figure 5A:
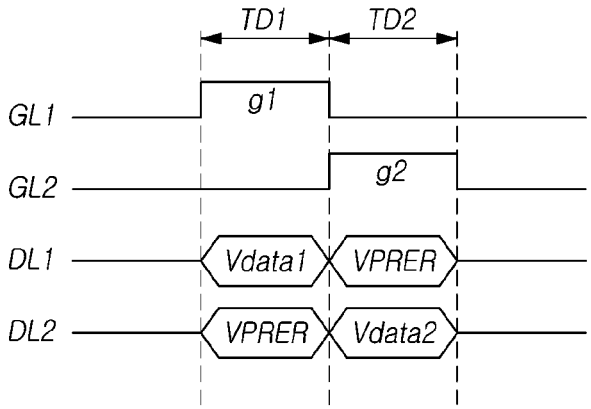
FIG. 5A is a timing diagram of signals in a driving mode, input to the pixels illustrated in FIG. 4.

FIG. 5A is a timing diagram of signals in a driving mode, input to the pixels illustrated in FIG. 4.

Referring to FIG. 5A, a driving mode may be a mode in which images are displayed on the display panel 110. The driving mode may include a first driving time TD1 and a second driving time TD2. However, the driving mode according to the present disclosure is not limited thereto.

In the first driving time TD1, a first gate signal g1 is supplied through the first gate line GL1, and a first data signal Vdata1 may be supplied through the first data line DL1. In addition, a driving initialization voltage VPRER may be supplied through the second data line DL2. In the first driving time TD1, the second transistor T2*a* and the third transistor T3*a* of the first pixel 101*a* may be turned on, in response to the first gate signal g1. Here, the second transistor T2*b* and the third transistor T3*b* of the second pixel 101*b* may remain turned off.

When the second transistor T2*a* and the third transistor T3*a* of the first pixel 101*a* are turned on, a data signal may be transferred to the first node N1*a* of the first pixel 101*a*, and the driving initialization voltage VPRER may be transferred to the second node N2*a* of the first pixel 101*a*. The first capacitor C1*a* and the anode of the organic light-emitting diode OLEDa are initialized by the driving initialization voltage VPRER, while driving current may be caused to flow from the first electrode to the second electrode of the first transistor T1*a* by the first data signal Vdata1 transferred to the first node N1*a*. Since the driving current can be supplied to the organic light-emitting diode OLEDa, light can be emitted from the first pixel 101*a*, with a driving current corresponding to the first data signal Vdata1 being supplied to the organic light-emitting diode OLEDa. Since the second transistor T2 and the third transistor T3*b* of the second pixel 101*b* remain turned off, no light is emitted from the second pixel 101*b*, with no driving current being supplied to the organic light-emitting diode OLEDb.

In the second driving time TD2, a second gate signal g2 may be supplied through the second gate line GL2, the driving initialization voltage VPRER may be supplied through the first data line DL1, and a second data signal Vdata2 may be supplied through the second data line DL2. In the second driving time TD2, the second transistor T2*a* and the third transistor T3*a* of the first pixel 101*a* may remain turned off, while the second transistor T2*b* and the third transistor T3*b* of the second pixel 101*b* may be turned on, in response to the second gate signal g2.

Since the second transistor T2*a* and the third transistor T3*a* remain turned off, no light is emitted from the first pixel 101*a*, with no driving current being supplied to the organic light-emitting diode OLEDa. When the second transistor T2*b* and the third transistor T3*b* of the second pixel 101*b* are turned on, the second data signal Vdata2 may be transferred to the first node N1*b* of the second pixel 101*b*, and the driving initialization voltage VPRER may be transferred to the second node N2*b*. The first capacitor C1*b* and the anode of the organic light-emitting diode OLEDb may be initialized by the driving initialization voltage VPRER, while driving current may be caused to flow from the first electrode to the second electrode of the first transistor T1*b* by the second data signal Vdata2 transferred to the first node N1*b*. Since the driving current can be supplied to the organic light-emitting diode OLEDb, light can be emitted from the second pixel 101*b*, with a driving current corresponding to the second data signal Data2 being supplied to the organic light-emitting diode OLEDb.

Figure 5B:
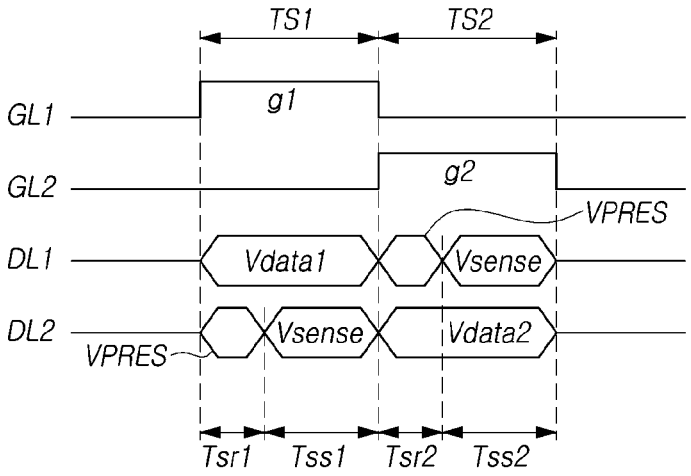
FIG. 5B is a timing diagram illustrating waveforms of signals in a sensing mode, input to the pixels illustrated in FIG. 4.

FIG. 5B is a timing diagram illustrating waveforms of signals in a sensing mode, input to the pixels illustrated in FIG. 4.

Referring to FIG. 5B, a sensing mode may be a mode in which the threshold voltage and/or mobility of the transistor T1 and the organic light-emitting diode of the pixels 101 disposed on the display panel 110 are sensed. The sensing mode may include a first sensing time TS1 and a second sensing time TS2. However, the sensing mode according to the present disclosure is not limited thereto.

The first sensing time TS1 may include a first writing time Tsr1 and a first read time Tss1, while the second sensing time TS2 may include a second writing time Tsr2 and a second read time Tss2. Although the writing times Tsr1 and Tsr2 are illustrated as being shorter than the read times Tss1 and Tss2 in FIG. 5B, this is only an illustrative example and the present disclosure is not limited thereto. In the first sensing time TS1, a first gate signal g1 may be transferred through the first gate line GL1. In the first sensing time TS1, the second transistor T2*a* and the third transistor T3*a* of the first pixel 101*a* may be turned on by the first gate signal g1. In addition, a first data signal Vdata1 may be transferred through the first data line DL1 in the first sensing time TS1, while a sensing initialization voltage VPRES may be transferred through the second data line DL2 in the first write time Tsr1 of the first sensing time TS1. Consequently, the sensing initialization voltage VPRES may be transferred to the second node N2*a* in the first write time Tsr1.

In the first sensing time TS1, when the first data signal Vdata1 is transferred to the gate electrode of the first transistor T1*a* of the first pixel 101*a*, a sensing current corresponding to the first data signal Vdata1 may flow through the first transistor T1*a*, in the direction from the first electrode to the second electrode. Here, the sensing initialization voltage VPRES may have a voltage level lower than the threshold voltage of the organic light-emitting diode OLEDa. Accordingly, the organic light-emitting diode OLEDa may not generate light.

In the first read time Tss1, the sensing initialization voltage VPRES may not be transferred through the second data line DL2. When the sensing initialization voltage VPRES is not transferred through the second data line DL2, the second data line DL2 may maintain the voltage of the second node N2*a*, and information regarding the threshold voltage, mobility, and the like of the transistor and the organic light-emitting diode may be determined by sensing the sensing voltage Vsense of the second data line DL2.

In the second time TS2, a second gate signal g2 may be transferred through the second gate line GL2. The second transistor T2*b* and the third transistor T3*b* of the second pixel 101*b* may be turned on by the second gate signal g2 in the second sensing time TS2. Consequently, in the second sensing time TS2, a second data signal Vdata2 may be transferred through the second data line DL2, while a sensing initialization voltage VPRES may be transferred through the first data line DIA. In addition, the sensing initialization voltage VPRES may be transferred through the first data line DL1 in the second write time Tsr2 of the second sensing time TS2. Consequently, the sensing initialization voltage VPRES can be transferred to the second node N2*b*, only in the second write time Tsr2.

In the second write time Tsr2, when the second data signal Vdata2 is transferred to the gate electrode of the first transistor T1*b* of the second pixel 101*b*, a sensing current corresponding to the second data signal Vdata2 may flow through the first transistor T1*b*, in the direction from the first electrode to the second electrode. Here, the sensing initialization voltage VPRES may have a voltage level lower than the threshold voltage of the organic light-emitting diode OLEDb. Accordingly, the organic light-emitting diode OLEDb may not generate light.

In the second read time Tss2, the sensing initialization voltage VPRES may not be transferred through the first data line DL1. When the sensing initialization voltage VPRES is not transferred through the first data line DL1, the first data line DL1 may maintain the voltage of the second node N2*b*, and information regarding the threshold voltage, mobility, and the like of the transistor and the organic light-emitting diode may be determined by sensing the sensing voltage Vsense of the first data line DL1.

Accordingly, it is possible to apply data signals and an initialization voltage to the pixels 101*a* and 101*b* using the data lines DL1 and DL2, instead of using a separate line, such as the second voltage line VL2 illustrated in FIG. 3. In addition, it is possible to sense sensing voltages Vsense applied to the data lines DL1 and DL2.

Figure 6:
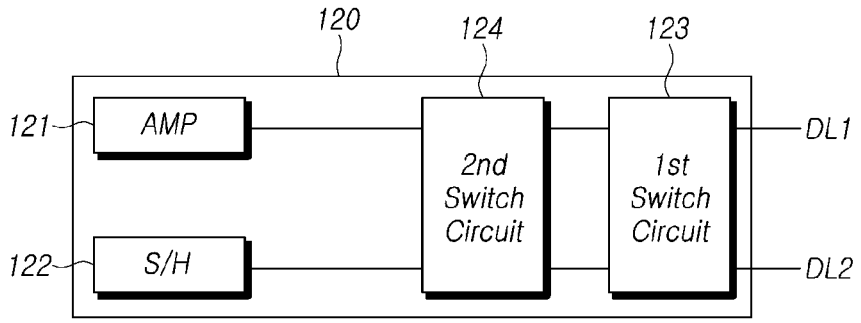
FIG. 6 is a block diagram illustrating an exemplary configuration of the data driver according to exemplary embodiments.

FIG. 6 is a block diagram illustrating an exemplary configuration of the data driver according to exemplary embodiments.

Referring to FIG. 6, the data driver 120 may include a first amplifier 121, a sample/hold circuit 122, a first switch circuit 123, and a second switch circuit 124. Both the first switch circuit 123 and the second switch circuit 124 may be connected to a first data line DL1 and a second data line DL2 to connect the first data line DL1 and the second data line DL2 to the first amplifier 121 or the sample/hold circuit 122 in response to driving mode and sensing mode. In addition, the first switch circuit 123 and the second switch circuit 124 may supply a driving initialization voltage VPRER or a sensing initialization voltage VPRES to the first data line DL1 or the second data line DL2 in response to the driving mode and the sensing mode. The driving mode may be a mode in which images are displayed on the display panel 110, while the sensing mode may be a mode in which the threshold voltage and/or mobility of the transistor T1 and the organic light-emitting diode of the pixels 101 disposed on the display panel 110 are sensed. In addition, the driving mode may include a first driving time TD1 and a second driving time TD1, while the sensing mode may include a first sensing time TS1 and a second sensing time TS2. However, neither the driving mode nor the sensing mode according to the present disclosure is limited thereto.

The first amplifier 121 may supply a data signal through the first data line DL1 in the first driving time TD1 while supplying a data signal through the second data line DL2 in the second driving time TD2. The first amplifier 121 may supply a first data signal Vdata1 through the first data line DL1 in the first sensing time TS1 while supplying a second data signal Vdata2 through the second data line DL2 in the second sensing time TS2. In addition, the first amplifier 121 may supply the first data signal Vdata1 through the first data line DL1 before supplying the second data signal Vdata2 through the second data line DL2. The first amplifier 121 may supply the first data signal and the second data signal sequentially through the first data line DL1 and the second data line DL2 by outputting the first data signal and the second data signal sequentially in the first driving time TD1 and the second driving time TD2.

The sample/hold circuit 122 may receive a sensing voltage through the second data line DL2 in the first sensing time TS1 while receiving a sensing voltage through the first data line DL1 in the second sensing time TS2.

The sample/hold circuit 122 may receive sensing voltages corresponding to the voltage of the second node N2*a* of the first pixel 101*a* and the voltage of the second node N2*b* of the second pixel 101*b* in the first sensing time TS1 and the second sensing time TS2. The sample/hold circuit 122 may sequentially receive the voltage of the second node N2*a* of the first pixel 101*a* and the voltage of the second node N2*b* of the second pixel 101*b* in the first sensing time TS1 and the second sensing time TS2.

Accordingly, the data driver 120 may be connected to the data lines DL1 and DL2 to transfer data signals and receive sensing voltages therethrough. This configuration of the data driver 120 can reduce the number of channels connected to other lines than the data lines DL1 and DL2.

Figure 7:
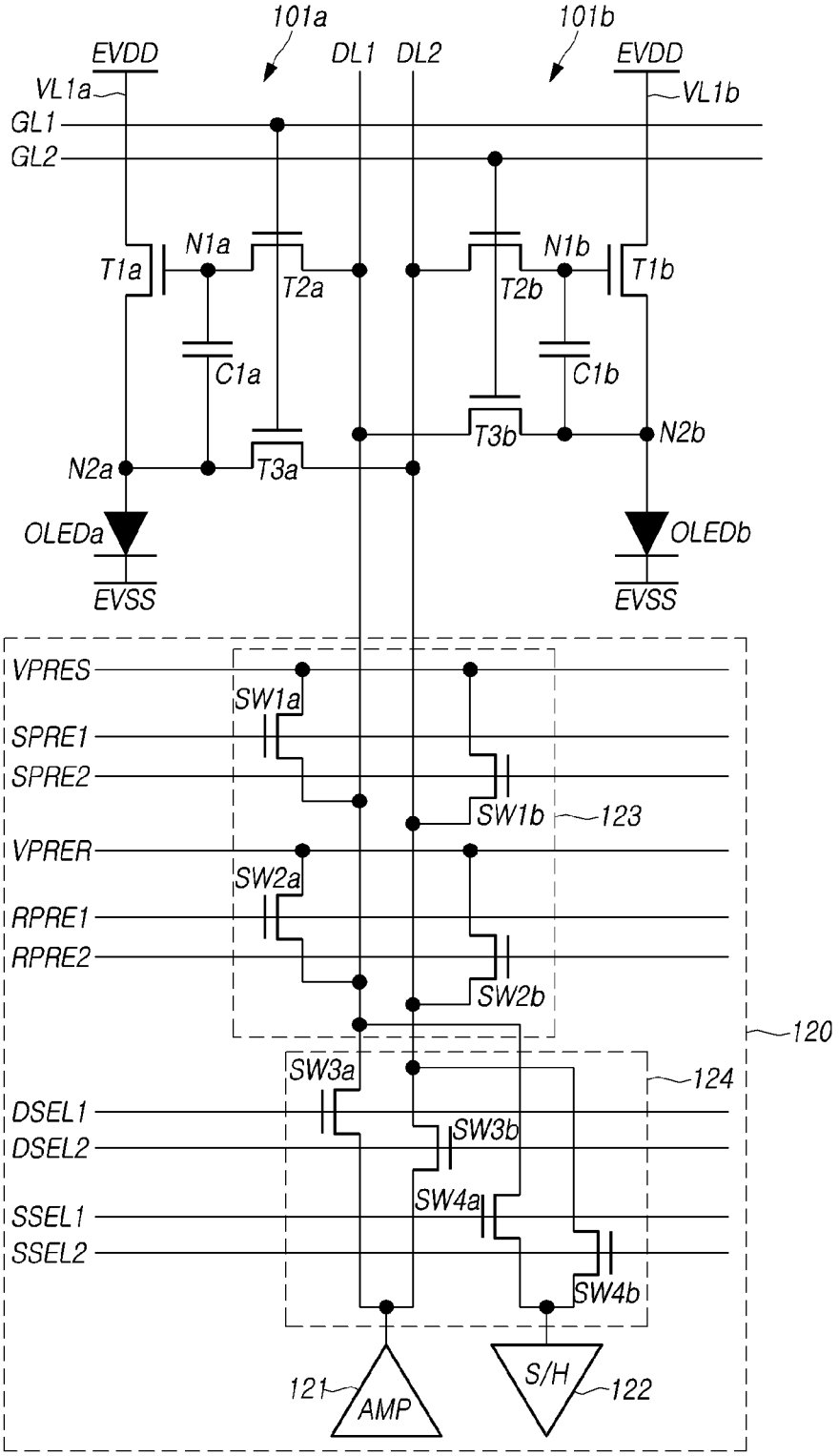
FIG. 7 is a circuit diagram illustrating an exemplary connection between the pixels and the data driver according to exemplary embodiments.

FIG. 7 is a circuit diagram illustrating an exemplary connection between the pixels and the data driver according to exemplary embodiments.

Referring to FIG. 7, a first pixel 101*a* and a second pixel 101*b* may be disposed on the display panel 110. The first pixel 101*a* and the second pixel 101*b* may be connected to the data driver 120 via a first data line DL1 and a second data line DL2. In addition, the first data line DL1 and the second data line DL2 may be disposed adjacently to each other, while a first gate line GL1 and a second gate line GL2 may be disposed adjacently to each other. The term "disposed adjacently" may mean that no pixel is disposed between the two lines.

In the first pixel 101*a*, a first transistor T1*a* may have a gate electrode connected to a first node N1*a*, a first electrode connected to a first voltage line VL1*a*, through which a first voltage EVDD is transferred, and a second electrode connected to a second node N2*a*. A second transistor T2*a* may have a gate electrode connected to the first gate line GL1, a first electrode connected to the first data line DL1, and a second electrode connected to the first node N1*a*. A third transistor T3*a* may have a gate electrode connected to the first gate line GL1, a first electrode connected to the second data line DL2, and a second electrode connected to the second node N2*a*. A first capacitor C1*a* may be disposed between the first node N1*a* and the second node N2*a*. In addition, an organic light-emitting diode OLEDa may have an anode connected to the second node N2*a* and a cathode to which a second voltage EVSS is transferred.

In the second pixel 101*b*, a first transistor T1*b* may have a gate electrode connected to a first node N1*b*, a first electrode connected to a first voltage line VL1*b*, and a second electrode connected to a second node N2*b*. A second transistor T2*b* may have a gate electrode connected to the second gate line GL2, a first electrode connected to the second data line DL2, and a second electrode connected to the first node N1*a*. A third transistor T3*b* may have a gate electrode connected to the second gate line GL2, a first electrode connected to the first data line DL1, and a second electrode connected to the second node N2*b*. A first capacitor C1*b* may be disposed between the first node N1*b* and the second node N2*b*. In addition, an organic light-emitting diode OLEDb may have an anode connected to the second node N2*b* and a cathode to which a second voltage EVSS is transferred.

The data driver 120 may include a first amplifier 121, a sample/hold circuit 122, a first switch circuit 123, and a second switch circuit 124.

The first amplifier 121 may supply a data signal through the first data line DL1 in the first driving time TD1 while supplying a data signal through the second data line DL2 in the second driving time TD2. The first amplifier 121 may supply a data signal through the first data line DL1 in the first sensing time TS1 while supplying a data signal through the second data line DL2 in the second sensing time TS2.

The sample/hold circuit 122 may receive a sensing voltage through the second data line DL2 in the first sensing time TS1 while receiving a sensing voltage through the first data line DL1 in the second sensing time TS2.

The first switch circuit 123 may include first to fourth switches SW1*a*, SW1*b*, SW2*a*, and SW2*b*. The first switch SW1*a* may selectively transfer a sensing initialization voltage VPRES to the first data line DL1, the second switch SW1*b* may selectively transfer the sensing initialization voltage VPRES to the second data line DL2, the third switch SW2*a* may selectively transfer a driving initialization voltage VPRER to the first data line DL1, and the fourth switch SW2*b* may selectively transfer the driving initialization voltage VPRER to the second data line DL2.

The first switch SW1*a* may be turned on by a first voltage selection signal SPRE1, while the second switch SW1*b* may be turned on by a second voltage selection signal SPRE2. In addition, the third switch SW2*a* may be turned on by a third voltage selection signal RPRE1, while the fourth switch SW2*b* may be turned on by a fourth voltage selection signal RPRE2.

The second switch circuit 124 may include fifth to eighth switches SW3*a*, SW3*b*, SW4*a*, and SW4*b*. The fifth switch SW3*a* and the sixth switch SW3*b* selectively connect the first amplifier 121 to the first data line DL1 or second data line DL2, in response to a first mode selection signal DSEL1 or a second mode selection signal DSEL2. The seventh switch SW4*a* and the eighth switch SW4*b* may selectively connect the sample/hold circuit 122 to the first data line DL1 or second data line DL2, in response to a third mode selection signal SSEL1 or a fourth mode selection signal SSEL2.

The fifth switch SW3*a* may be turned on by the first mode selection signal DSEL1, the sixth switch SW3*b* may be turned on by the second mode selection signal DSEL2, the seventh switch SW4*a* may be turned on by the third mode selection signal SSEL1, and the eighth switch SW4*b* may be turned on by the fourth mode selection signal SSEL2.

The first to eighth switches SW1*a* to SW4*b*, included in the first switch circuit 123 and the second switch circuit 124, may be p-type metal oxide semiconductor (MOS) transistors.

Figure 8A:
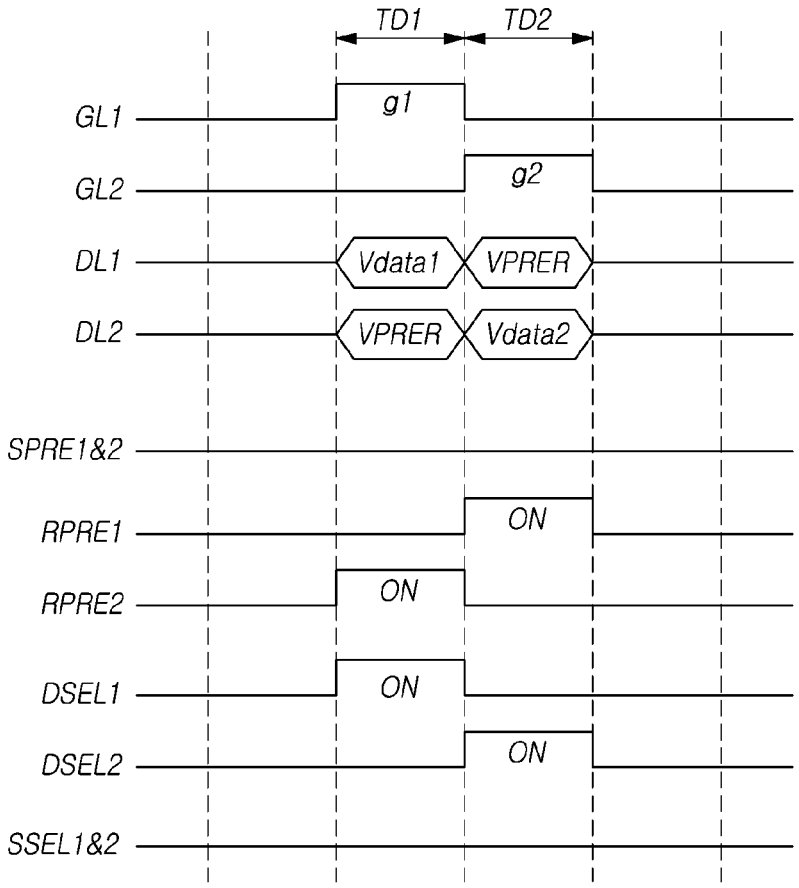
FIG. 8A is a timing diagram illustrating waveforms of signals in a driving mode, input to the pixels and the data driver illustrated in FIG. 7.

FIG. 8A is a timing diagram illustrating waveforms of signals in a driving mode, input to the pixels and the data driver illustrated in FIG. 7.

Referring to FIG. 8A, a first gate signal g1 may be transferred in the first driving time TD1. In addition, in the first driving time TD1, a fourth voltage selection signal RPRE2 may be transferred as a turn-on signal ON, and a first mode selection signal DSEL1 may be transferred as a turn-on signal ON. Consequently, in the first driving time TD1, the second transistor T2*a* and the third transistor T3*a* of the first pixel 101*a* may be turned on by the first gate signal g1. In addition, in the first driving time TD1, the fourth switch SW2*b* may be turned on by the fourth voltage selection signal RPRE2, and the fifth switch SW3*a* may be turned on by the first mode selection signal DSEL1. Consequently, in the first driving time TD1, a first data signal Vdata1 may be transferred through the first data line DL1, and a driving initialization voltage VPRER may be transferred through the second data line DL2.

Accordingly, the first data signal Vdata1 may be transferred to the first node N1*a* of the first pixel 101*a*, and the driving initialization voltage VPRER may be transferred to the second node N2*a* of the first pixel 101*a*. The first data signal Vdata1 may also be transferred to the gate electrode of the first transistor T1*a* of the first pixel 101*a*, so that a driving current corresponding to the first data signal Vdata1 can flow through the first transistor T1*a*, in the direction from the first electrode to the second electrode. Here, since the driving initialization voltage VPRER is transferred to the second electrode of the first transistor T1*a*, the driving current flowing from the first electrode to the second electrode can be corrected by the driving initialization voltage VPRER. Thus, the driving current flowing through the organic light-emitting diode OLEDa can be corrected by the driving initialization voltage VPRER. When the driving initialization voltage VPRER corresponds to information regarding a threshold voltage, mobility, and the like, the driving current flowing through the organic light-emitting diode OLEDa may be a driving current compensated for the threshold voltage and mobility.

In the second driving time TD2, a second gate signal g2 may be transferred. In the second driving time TD2, a third voltage selection signal RPRE1 may be transferred as a turn-on signal ON, and a second mode selection signal DSEL2 may be transferred as a turn-on signal. Thus, in the second driving time TD2, the second transistor T2*b* and the third transistor T3*b* of the second pixel 101*b* may be turned on by the second gate signal g2. In addition, in the second driving time TD2, the third switch SW2*a* may be turned on by the third voltage selection signal RPRE1, and the sixth switch SW3*b* may be turned on by a second mode selection signal DSEL2. Consequently, in the second driving time TD2, a second data signal Vdata2 may be transferred through the second data line DL2, while the driving initialization voltage VPRER may be transferred through the first data line DL1.

Accordingly, the second data signal Vdata2 may be transferred to the first node N1*b* of the second pixel 101*b*, and the driving initialization voltage VPRER may be transferred to the second node N2*b* of the second pixel 101*b*. The second data signal Vdata2 may also be transferred to the gate electrode of the first transistor T1*b* of the second pixel 101*b*, so that a driving current corresponding to the second data signal Vdata2 may flow through the first transistor T1*b*, in the direction from the first electrode to the second electrode. Since the driving initialization voltage VPRER is transferred to the second electrode of the first transistor T1*b*, the driving current flowing from the first electrode to the second electrode can be corrected by the driving initialization voltage VPRER. Thus, the driving current flowing through the organic light-emitting diode OLEDb can be corrected by the driving initialization voltage VPRER. When the driving initialization voltage VPRER corresponds to information regarding a threshold voltage, mobility, and the like, the driving current flowing through the organic light-emitting diode OLEDb may be a driving current compensated for the threshold voltage and mobility.

Figure 8B:
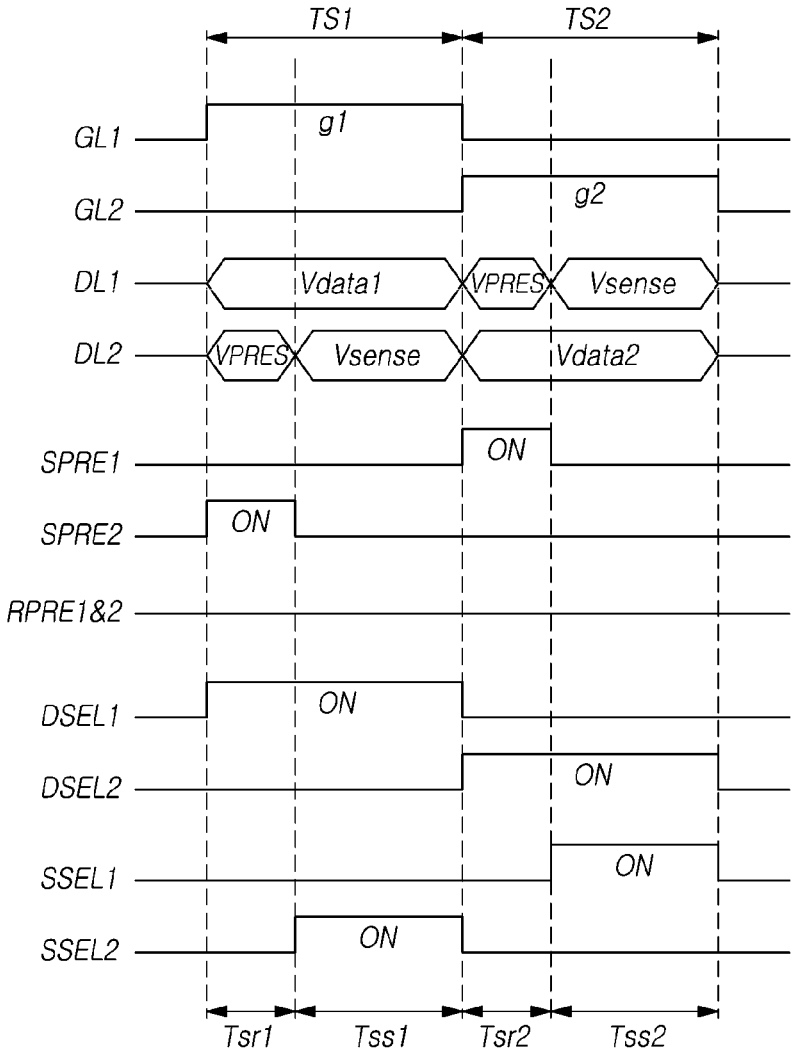
FIG. 8B is another timing diagram illustrating waveforms of signals in a sensing mode, input to the pixels and the data driver illustrated in FIG. 7.

FIG. 8B is another timing diagram illustrating waveforms of signals input to the pixels and the data driver illustrated in FIG. 7.

Referring to FIG. 8B, the first sensing time TS1 may include a first write time Tsr1 and a first read time Tss1, while the second sensing time TS2 may include a second write time Tsr2 and a second read time Tss2.

In the first sensing time TS1, a first gate signal g1 may be transferred through the first gate line GL1. In addition, in the first write time Tsr1 of the first sensing time TS1, a second voltage selection signal SPRE2 may be transferred as a turn-on signal ON, and a first mode selection signal DSEL1 may be transferred as a turn-on signal ON. In addition, in the first read time Tss1, a fourth mode selection signal SSEL2 may be transferred as a turn-on signal ON. Thus, in the first sensing time TS1, the second transistor T2*a* and the third transistor T3*a* of the first pixel 101*a* may be turned on by the first gate signal g1, and the fifth switch SW3*a* may be turned on by the first mode selection signal DSEL1. In addition, the second switch SW1*b* may be turned on by the second voltage selection signal SPRE2 in the first write time Tsr1 of the first sensing time TS1, while the eighth switch SW4*b* may be turned on by the fourth mode selection signal SSEL2 in the first read time Tss1 of the first sensing time TS1.

Consequently, in the first sensing time TS1, a first data signal Vdata1 may be transferred to the first data line DL1, and a sensing initialization voltage VPRES may be transferred to the second data line DL2. In addition, in the first write time Tsr1 of the first sensing time TS1, the sensing initialization voltage VPRES may be transferred through the second data line DL2. Consequently, the sensing initialization voltage VPRES can be transferred to the second node N2*a*, only in the first write time Tsr1.

In the first write time Tsr1, when the first data signal Vdata1 is transferred to the gate electrode of the first transistor T1*a* of the first pixel 101*a*, a sensing current corresponding to the first data signal Vdata1 may flow through the first transistor T1*a*, in the direction from the first electrode to the second electrode. Here, the sensing initialization voltage VPRES may have a voltage level lower than the threshold voltage of the organic light-emitting diode OLEDa. Accordingly, the organic light-emitting diode OLEDa may not generate light.

In the first read time Tss1, the second switch SW1*b* may be turned off, while the eighth switch SW4*b* may be turned on. In addition, the fifth switch SW3*a* may remain turned on. When the second switch SW1*b* is turned off, the sensing initialization voltage VPRES may not be further transferred to the second data line DL2. Since the eighth switch SW4*b* remains turned on, the sample/hold circuit 122 may be connected to the second data line DL2. Thus, in the first read time Tss1, the sample/hold circuit 122 can receive the voltage of the second node N2*a* of the first pixel 101*a* via the third transistor T3*a*, the second data line DL2, and the eighth switch SW4*b*.

In the second sensing time TS2, a second gate signal g2 may be transferred through the second gate line GL2. In addition, in the second write time Tsr2 of the second sensing time TS2, a first voltage selection signal SPRE1 may be transferred as a turn-on signal ON, and a second mode selection signal DSEL2 may be transferred as a turn-on signal ON. In addition, in the second read time Tss2, a third mode selection signal SSEL1 may be transferred as a turn-on signal ON. Thus, in the second sensing time TS2, the second transistor T2*b* and the third transistor T3*b* of the second pixel 101*b* may be turned on by the second gate signal g2, and the sixth switch SW3*b* may be turned on by the second mode selection signal DSEL2. In addition, the first switch SW1*a* may be turned on by the first voltage selection signal SPRE1 in the second write time Tsr2 of the second sensing time TS2, while the seventh switch SW4*a* may be turned on by the third mode selection signal SSEL1 in the second read time Tss2 of the second sensing time TS2.

Consequently, a second data signal Vdata2 may be transferred through the second data line DL2, while a sensing initialization voltage VPRES may be transferred through the first data line DL1. In addition, in the second write time Tsr2 of the second sensing time TS2, the sensing initialization voltage VPRES may be transferred through the first data line DL1. Consequently, the sensing initialization voltage VPRES can be transferred to the second node N2*b*, only in the second write time Tsr2.

In the second write time Tsr2, when the second data signal Vdata2 is transferred to the gate electrode of the first transistor T1*b* of the second pixel 101*b*, a sensing current corresponding to the second data signal Vdata2 may flow through the first transistor T1*b*, in the direction from the first electrode to the second electrode. Here, the sensing initialization voltage VPRES may have a voltage level lower than the threshold voltage of the organic light-emitting diode OLEDb. Accordingly, the organic light-emitting diode OLEDb may not generate light.

In the second read time Tss2, the first switch SW1*a* may be turned off, and the seventh switch SW4*a* may be turned on. In addition, the sixth switch SW3*b* may remain turned on. When the first switch SW1*a* is turned off, the sensing initialization voltage VPRES may not be further transferred through the first data line DL1. Since the seventh switch SW4*a* remains turned on, the sample/hold circuit 122 may be connected to the first data line DL1. Consequently, in the second read time Tss2, the sample/hold circuit 122 can receive the voltage of the second node N2*b* of the second pixel 101*b* via the third transistor T3*b*, the first data line DL1, and the seventh switch SW4*a*.

Figure 9:
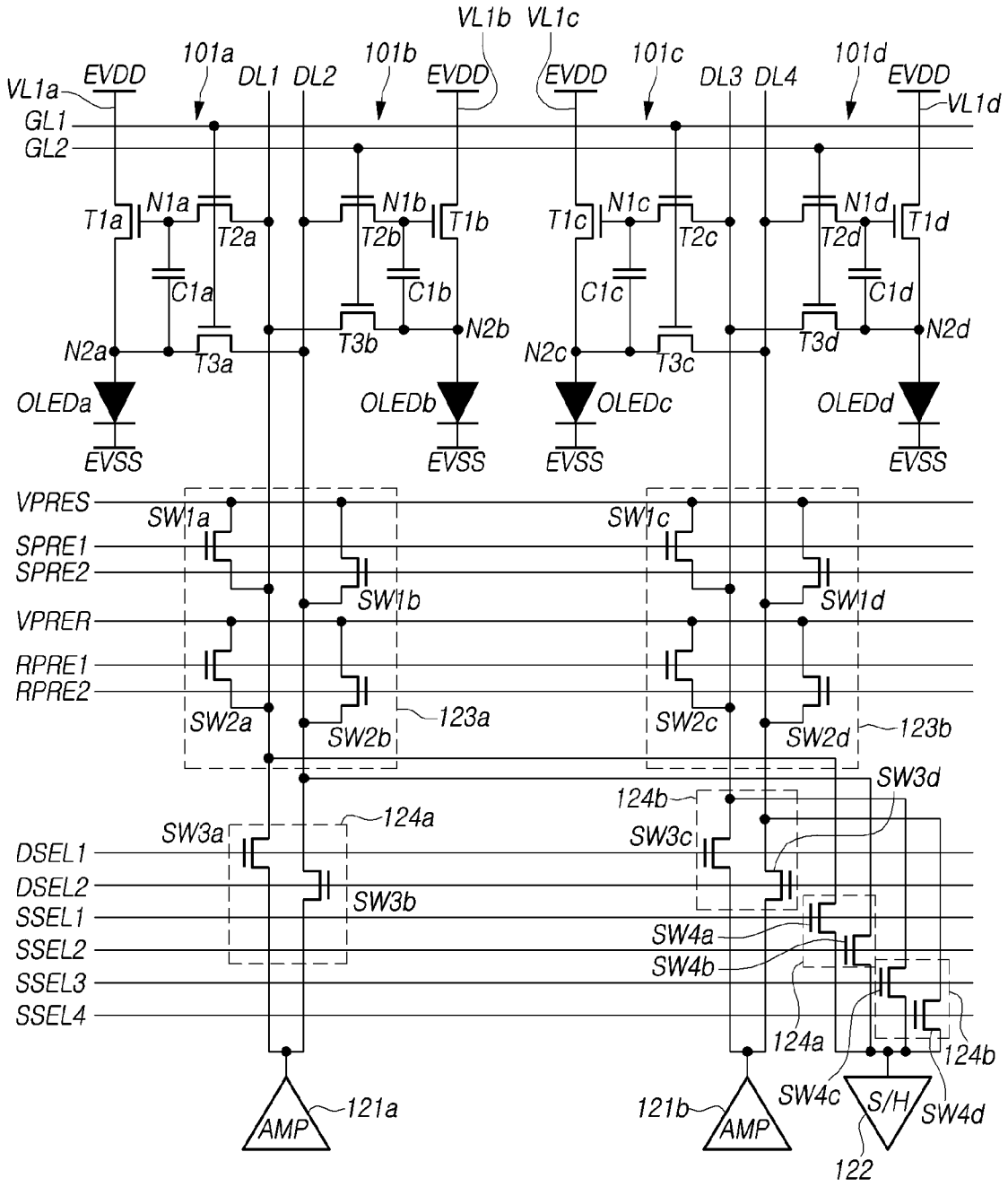
FIG. 9 is a circuit diagram illustrating another exemplary connection between the pixels and the data driver according to exemplary embodiments.

FIG. 9 is a circuit diagram illustrating another exemplary connection between the pixels and the data driver according to exemplary embodiments.

Referring to FIG. 9, the first pixel 101*a*, the second pixel 101*b*, the third pixel 101*c*, and the fourth pixel 101*d* may be disposed on the display panel 110. In addition, each of the first to fourth pixels 101*a*, 101*b*, 101*c*, and 101*d* may be a pixel emitting one of red light, green light, blue light, and white light. However, colors of light that the first to fourth pixels 101*a* to 101*d* emit are not limited thereto. The first pixel 101*a* and the second pixel 101*b* may be connected to the data driver 120 through the first data line DL1 and the second data line DL2, while the third pixel 101*c* and the fourth pixel 101*d* may be connected to the data driver 120 through a third data line DL3 and a fourth data line DL4. The data driver 120 may be one of a plurality of driver ICs. However, the data driver according to the present disclosure is not limited thereto. The first data line DL1 and the second data line DL2 may be disposed adjacently to each other, while the third data line DL3 and the fourth data line DL4 may be disposed adjacently to each other. In addition, the first gate line GL1 and the second gate line GL2 may be disposed adjacently to each other. The term "disposed adjacently" may mean that no pixel is disposed between the two lines.

In the first pixel 101*a*, a first transistor T1*a* may have a gate electrode connected to a first node N1*a*, a first electrode connected to a first voltage line VL1*a*, through which a first voltage EVDD is transferred, and a second electrode connected to a second node N2*a*. A second transistor T2*a* may have a gate electrode connected to the first gate line GL1, a first electrode connected to the first data line DL1, and a second electrode connected to the first node N1*a*. A third transistor T3*a* may have a gate electrode connected to the first gate line GL1, a first electrode connected to the second data line DL2, and a second electrode connected to the second node N2*a*. A first capacitor C1*a* may be disposed between the first node N1*a* and the second node N2*a*. In addition, an organic light-emitting diode OLEDa may have an anode connected to the second node N2*a* and a cathode to which a second voltage EVSS is transferred.

In the second pixel 101*b*, a first transistor T1*b* may have a gate electrode connected to a first node N1*b*, a first electrode connected to a first voltage line VL1*b*, and a second electrode connected to a second node N2*b*. A second transistor T2*b* may have a gate electrode connected to the second gate line GL2, a first electrode connected to the second data line DL2, and a second electrode connected to the first node N1*b*. A third transistor T3*b* may have a gate electrode connected to the second gate line GL2, a first electrode connected to the first data line DL1, and a second electrode connected to the second node N2*b*. A first capacitor C1*b* may be disposed between the first node N1*b* and the second node N2*b*. In addition, an organic light-emitting diode OLEDb may have an anode connected to the second node N2*b* and a cathode to which a second voltage EVSS is transferred.

In the third pixel 101*c*, a first transistor T1*c* may have a gate electrode connected to a first node N1*c*, a first electrode connected to a first voltage line VL1*c*, through which a first voltage EVDD is transferred, and a second electrode connected to a second node N2*c*. A second transistor T2*c* may have a gate electrode connected to the first gate line GL1, a first electrode connected to the third data line DL3, and a second electrode connected to the first node N1*c*. A third transistor T3*c* may have a gate electrode connected to the first gate line GL1, a first electrode connected to the fourth data line DL4, and a second electrode connected to the second node N2*c*. A first capacitor C1*c* may be disposed between the first node N1*c* and the second node N2*c*. In addition, an organic light-emitting diode OLEDc may have an anode connected to the second node N2*c* and a cathode to which a second voltage EVSS is transferred.

In the fourth pixel 101*d*, a first transistor T1*d* may have a gate electrode connected to a first node N1*d*, a first electrode connected to a first voltage line VL1*d*, and a second electrode connected to a second node N2*d*. A second transistor T2*d* may have a gate electrode connected to the second gate line GL2, a first electrode connected to the fourth data line DL4, and a second electrode connected to the first node N1*d*. A third transistor T3*d* may have a gate electrode connected to the second gate line GL2, a first electrode connected to the third data line DL3, and a second electrode connected to the second node N2*d*. A first capacitor C1*d* may be disposed between the first node N1*d* and the second node N2*d*. In addition, an organic light-emitting diode OLEDd may have an anode connected to the second node N2*d* and a cathode to which a second voltage EVSS is transferred.

The data driver 120 may include a first switch circuit 123*a*, a second switch circuit 124*a*, a third switch circuit 123*b*, and a fourth switch circuit 124*b*. In addition, the data driver 120 may further include a first amplifier 121*a* selectively connected to the first data line DL1 and the second data line DL2, a second amplifier 121*b* selectively connected to the third data line DL3 and the fourth data line DL4, and a sample/hold circuit 122 selectively connected to the first to fourth data lines DL1 to DL4.

The first switch circuit 123*a* may include a first switch SW1*a*, a second switch SW1*b*, a third switch SW2*a*, and a fourth switch SW2*b*. The first and second switches SW1*a* and SW1*b* may selectively transfer a sensing initialization voltage VPRES to the first data line DL1 and the second data line DL2, in response to a first voltage selection signal SPRE1 and a second voltage selection signal SPRE2, while the third and fourth switches SW2*a* and SW2*b* may selectively transfer a driving initialization voltage VPRER to the first data line DL1 and the second data line DL2, in response to a third voltage selection signal RPRE1 and a fourth voltage selection signal RPRE2.

The first switch SW1*a* may be turned on by the first voltage selection signal SPRE1, while the second switch SW1*b* may be turned on by the second voltage selection signal SPRE2. In addition, the third switch SW2*a* may be turned on by the third voltage selection signal RPRE1, while the fourth switch SW2*b* may be turned on by the fourth voltage selection signal RPRE2.

The second switch circuit 124*a* may include a fifth switch SW3*a*, a sixth switch SW3*b*, a seventh switch SW4*a*, and an eighth SW4*b*. The fifth switch SW3*a* and the sixth switch SW3*b* may selectively connect the first amplifier 121*a* to the first data line DL1 or the second data line DL2, in response to a first mode selection signal DSEL1 and a second mode selection signal DSEL2, while the seventh and eighth switches SW4*a* and SW4*b* may selectively connect the sample/hold circuit 122 to the first data line DL1 or the second data line DL2, in response to a third mode selection signal SSEL1 and a fourth mode selection signal SSEL2.

The fifth switch SW3*a* may be turned on by the first mode selection signal DSEL1, the sixth switch SW3*b* may be turned on by the second mode selection signal DSEL2, the seventh switch SW4*a* may be turned on by the third mode selection signal SSEL1, and the eighth switch SW4*b* may be turned on by the fourth mode selection signal SSEL2.

The third switch circuit 123*b* may include a ninth switch SW1*c*, a tenth switch SW1*d*, an eleventh switch SW2*c*, and a twelfth switch SW2*d*. The ninth switch SW1*c* and the tenth switch SW1*d* may selectively transfer a sensing initialization voltage VPRES to the third data line DL3 and the fourth data line DL4, in response to the first voltage selection signal SPRE1 and the second voltage selection signal SPRE2, while the eleventh switch SW2*c* and the twelfth switch SW2*d* may selectively transfer a driving initialization voltage VPRER to the third data line DL3 and the fourth data line DL4, in response to the third voltage selection signal RPRE1 and the fourth voltage selection signal RPRE2.

The ninth switch SW1*c* may be turned on by the first voltage selection signal SPRE1, while the tenth switch SW1*d* may be turned on by the second voltage selection signal SPRE2. In addition, the eleventh switch SW2*c* may be turned on by the third voltage selection signal RPRE1, while the twelfth switch SW2*d* may be turned on by the fourth voltage selection signal RPRE2.

The fourth switch circuit 124*b* may include a thirteen switch SW3*c*, a fourteenth switch SW3*d*, a fifteenth switch SW4*c*, and a sixteenth switch SW4*d*. The thirteen switch SW3*c* and the fourteenth switch SW3*d* may selectively connect the second amplifier 121*b* to the third data line DL3 or the fourth data line DL4, in response to the first mode selection signal DSEL1 and the second mode selection signal DSEL2, while the fifteenth switch SW4*c* and the sixteenth switch SW4*d* may selectively connect the sample/hold circuit 122 to the third data line DL3 or the fourth data line DL4, in response to a fifth mode selection signal SSEL3 and a sixth mode selection signal SSEL4.

The thirteen switch SW3*c* may be turned on by the first mode selection signal DSEL1, while the fourteenth switch SW3*d* may be turned on by the second mode selection signal DSEL2. In addition, the fifteenth switch SW4*c* may be turned on by the fifth mode selection signal SSEL3, while the sixteenth switch SW4*d* may be turned on by the sixth mode selection signal SSEL4.

Figure 10A:
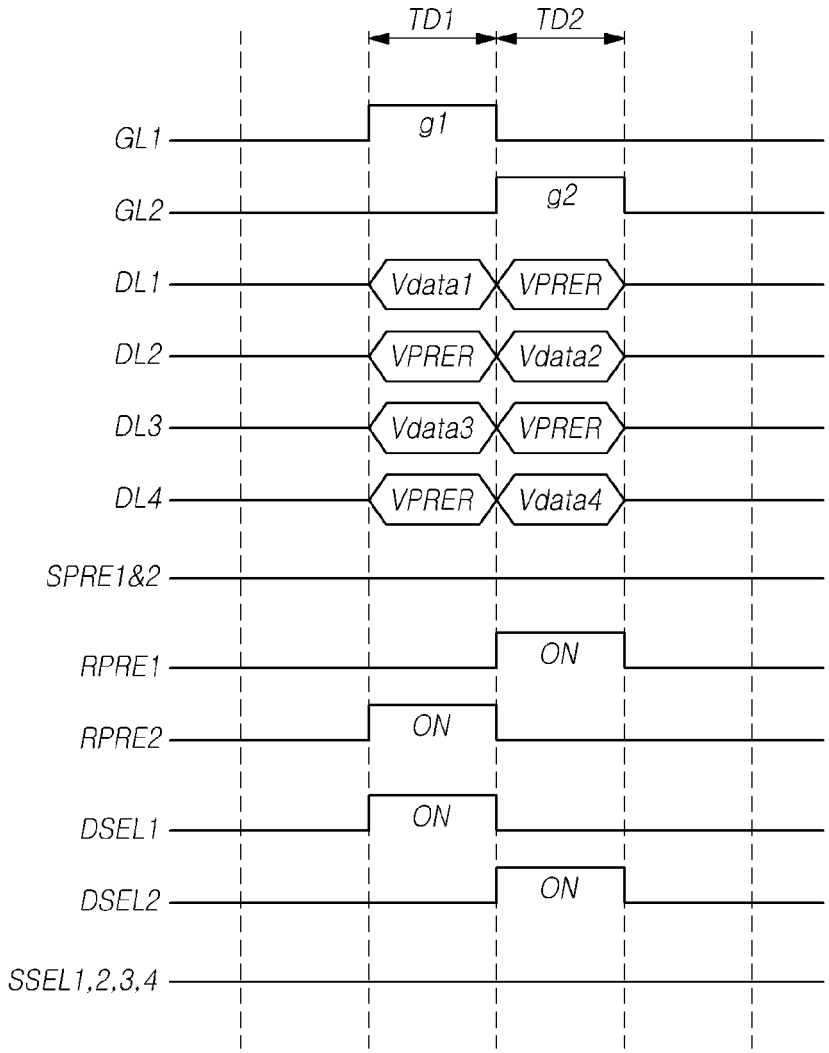
FIG. 10A is a timing diagram illustrating waveforms of signals in a driving mode, input to the pixels and the data driver illustrated in FIG. 9.

FIG. 10A is a timing diagram illustrating waveforms of signals in a driving mode, input to the pixels and the data driver illustrated in FIG. 9.

Referring to FIG. 10A, in the first driving time TD1, a first gate signal g1 may be transferred. In addition, in the first driving time TD1, a fourth voltage selection signal RPRE2 may be transferred as a turn-on signal ON, and a first mode selection signal DSEL1 may be transferred as a turn-on signal ON. Consequently, in the first driving time TD1, the second transistor T2*a* and the third transistor T3*a* of the first pixel 101*a* may be turned on by the first gate signal g1. The second transistor T2*c* and the third transistor T3*c* of the third pixel 101*c* may be turned on by the first gate signal g1. In addition, in the first driving time TD1, the fourth switch SW2*b* may be turned on by the fourth voltage selection signal RPRE2, and the fifth switch SW3*a* may be turned on by the first mode selection signal DSEL1. In addition, the twelfth switch SW2*d* may be turned on by the fourth voltage selection signal RPRE2, while the thirteenth switch SW3*c* may be turned on by the first mode selection signal DSEL1. Consequently, in the first driving time TD1, a first data signal Vdata1 may be transferred through the first data line DL1, a driving initialization voltage VPRER may be transferred through the second data line DL2, a third data signal Vdata3 may be transferred through the third data line DL3, and a driving initialization voltage VPRER may be transferred through the fourth data line DL4.

Accordingly, the first data signal Vdata1 may be transferred to the first node N1*a* of the first pixel 101*a*, and the driving initialization voltage VPRER may be transferred to the second node N2*a* of the first pixel 101*a*. The first data signal Vdata1 may also be transferred to the gate electrode of the first transistor T1*a* of the first pixel 101*a*, so that a driving current corresponding to the first data signal Vdata1 can flow through the first transistor T1*a*, in the direction from the first electrode to the second electrode. A third data signal Vdata3 may be transferred to the first node N1*c* of the third pixel 101*c*, and a driving initialization voltage VPRER may be transferred to the second node N2*c* of the third pixel 101*c*. The third data signal Vdata3 may also be transferred to the gate electrode of the first transistor T1*c* of the third pixel 101*c*, so that a driving current corresponding to the third data signal Vdata3 can flow through the first transistor T1*c*, in the direction from the first electrode to the second electrode.

Here, since the driving initialization voltage VPRER is transferred to the second electrodes of the first transistors T1*a* and T1*c*, the driving current flowing from the first electrode to the second electrode can be corrected by the driving initialization voltage VPRER. Thus, the driving current flowing through the organic light-emitting diodes OLEDa and OLEDc can be corrected by the driving initialization voltage VPRER. When the driving initialization voltage VPRER corresponds to information regarding a threshold voltage, mobility, and the like, the driving current flowing through the organic light-emitting diodes OLEDa and OLEDc may be a driving current compensated for the threshold voltage and mobility.

In the second driving time TD2, a second gate signal g2 may be transferred. In the second driving time TD2, a third voltage selection signal RPRE1 may be transferred as a turn-on signal ON, and a second mode selection signal DSEL2 may be transferred as a turn-on signal. Thus, in the second driving time TD2, the second transistor T2*b* and the third transistor T3*b* of the second pixel 101*b* may be turned on by the second gate signal g2. In addition, the second transistor T2*d* and the third transistor T3*d* of the fourth pixel 101*d* may be turned on by the second gate signal g2.

In the second driving time TD2, the third switch SW2*a* may be turned on by the third voltage selection signal RPRE1, while the sixth switch SW3*b* may be turned on by the second mode selection signal DSEL2. In addition, the eleventh switch SW2*c* may be turned on by the third voltage selection signal RPRE1, while the fourteenth switch SW3*d* may be turned on by the second mode selection signal DSEL2. Consequently, in the second driving time TD2, the second data signal Vdata2 may be transferred through the second data line DL2, the driving initialization voltage VPRER may be transferred through the first data line DL1, the fourth data signal Vdata4 may be transferred through the fourth data line DL4, and the driving initialization voltage VPRER may be transferred through the third data line DL3.

Consequently, the second data signal Vdata2 may be transferred to the first node N1*b* of the second pixel 101*b*, while the driving initialization voltage VPRER may be transferred to the second node N1*b* of the second pixel 101*b*. In addition, the second data signal Vdata2 may be transferred to the gate electrode of the first transistor T1*b* of the second pixel 101*b*, so that a driving current corresponding to the second data signal Vdata2 can flow through the first transistor T1*b*, in the direction from the first electrode to the second electrode. The fourth data signal Vdata4 may be transferred to the first node N1*d* of the fourth pixel 101*d*, while the driving initialization voltage VPRER may be transferred to the second node N2*d* of the fourth pixel 101*d*. In addition, the fourth data signal Vdata4 may be transferred to the gate electrode of the first transistor T1*d* of the fourth pixel 101*d*, so that a driving current corresponding to the fourth data signal Vdata4 can flow through the first transistor T1*d*, in the direction from the first electrode to the second electrode. Here, since the driving initialization voltage VPRER is transferred to the second electrodes of the first transistors T1*b* and T1*d* of the second pixel 101*b* and the fourth pixel 101*d*, the driving current flowing from the first electrode to the second electrode of the first transistors T1*b* and T1*d* can be corrected by the driving initialization voltage VPRER. Consequently, the driving current flowing through the organic light-emitting diodes OLEDb and OLEDd can be corrected by the driving initialization voltage VPRER. When the driving initialization voltage VPRER corresponds to information regarding a threshold voltage, mobility, and the like, the driving current flowing through the organic light-emitting diodes OLEDb and OLEDd may be a driving current compensated for the threshold voltage and mobility.

Figure 10B:
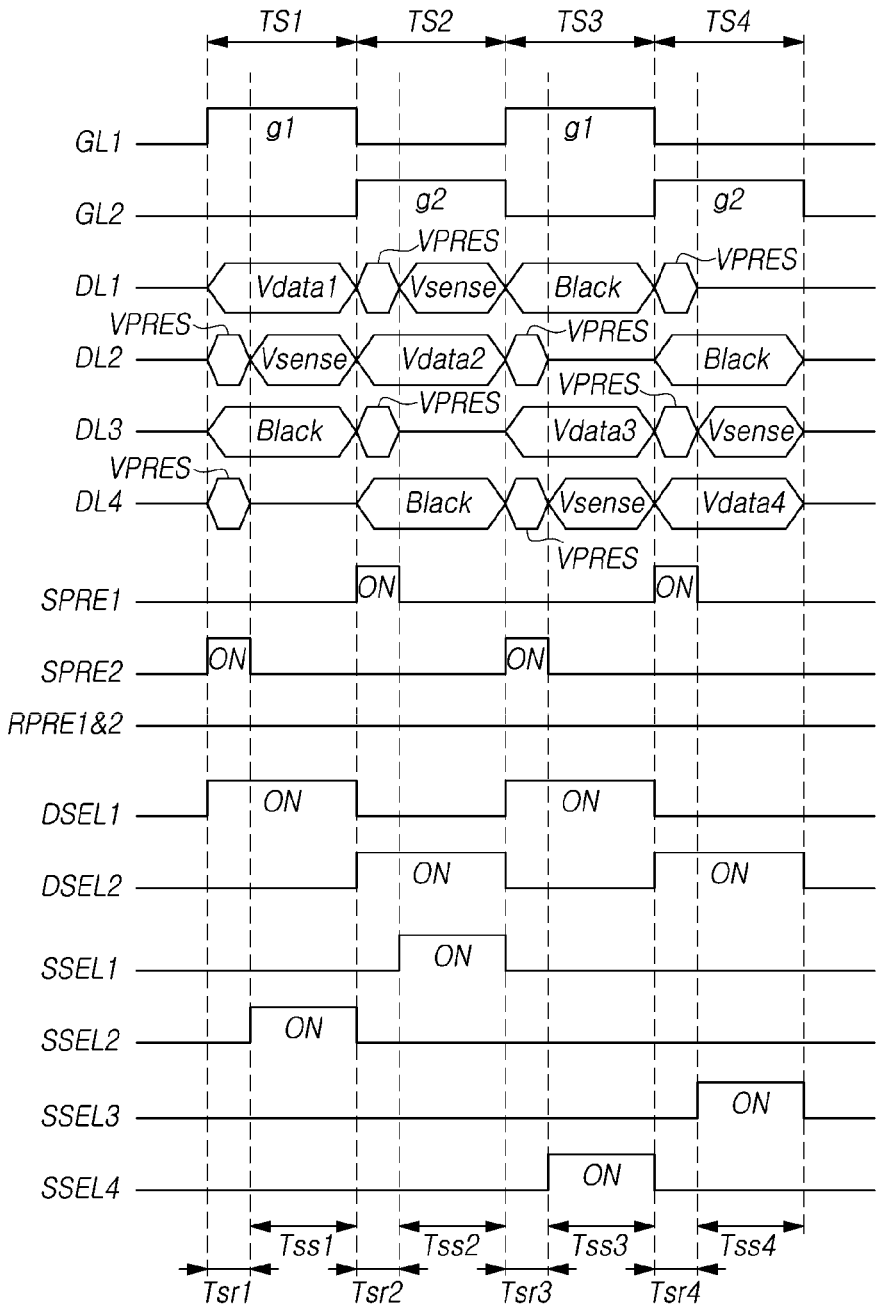
FIG. 10B is a timing diagram illustrating waveforms of signals in a sensing mode, input to the pixels and the data driver illustrated in FIG. 9.

FIG. 10B is a timing diagram illustrating waveforms of signals in a sensing mode, input to the pixels and the data driver illustrated in FIG. 9.

Referring to FIG. 10B, when a data signal Vdata is applied through one of the first data line DL1 and the second data line DL2, a sensing initialization voltage VPRES may be applied to the other of the first data line DL1 and the second data line DL2. When a black data voltage BLACK is applied through one of the first data line DL1 and the second data line DL2, a sensing initialization voltage VPRES may be applied to the other of the first data line DL1 and the second data line DL2.

The first sensing time TS1 may include a first write time Tsr1 and a first read time Tss1, while the second sensing time TS2 may include a second write time Tsr2 and a second read time Tss2. The third sensing time TS3 may include a third write time Tsr3 and a third read time Tss3, while the fourth sensing time TS4 may include a fourth write time Tsr4 and a fourth read time Tss4.

In the first sensing time TS1, the third data line DL3 may receive a black data signal. In the second sensing time TS2, the fourth data line DL4 may receive a black data signal. In the third sensing time TS3, the first data line DL1 may receive a black data signal. In the fourth sensing time TS4, the second data line DL2 may receive a black data signal.

At least one data line, among the first to fourth data lines DL1 to DL4, may receive a data voltage Vdata1 corresponding to the data signal in first sensing time TS1, a sensing initialization voltage VPRES in the second write time Tsr2 of the second sensing time TS2, a black data voltage BLACK corresponding to the black data signal in the third sensing time TS3, and a sensing initialization voltage VPRES in the fourth write time Tsr4 of the fourth sensing time TS4.

In the first sensing time TS1, a first gate signal g1 may be transferred through the first gate line GL1. In addition, in the first write time Tsr1 of the first sensing time TS1, a second voltage selection signal SPRE2 may be transferred as a turn-on signal ON. A first mode selection signal DSEL1 may be transferred as a turn-on signal ON. In addition, in the first read time Tss1, a fourth mode selection signal SSEL2 may be transferred as a turn-on signal ON. Consequently, in the first sensing time TS1, the second transistor T2*a* and the third transistor T3*a* of the first pixel 101*a* may be turned on by the first gate signal g1, and the fifth switch SW3*a* may be turned on by the first mode selection signal DSEL1. In the first write time Tsr1 of the first sensing time TS1, the second switch SW1*b* may be turned on by the second voltage selection signal SPRE2. In the first read time Tss1 of the first sensing time TS1, the eighth switch SW4*b* may be turned on by the fourth mode selection signal SSEL2.

Consequently, in the first sensing time TS1, the first data signal Vdata1 may be transferred through the first data line DL1, while the sensing initialization voltage VPRES may be transferred through the second data line DL2. In addition, in the first write time Tsr1 of the first sensing time TS1, the sensing initialization voltage VPRES may be transferred through the second data line DL2. Consequently, the sensing initialization voltage VPRES may be transferred to the second node N2*a*, only in the first write time Tsr1.

In the first write time Tsr1, when the first data signal VData1 is transferred to the gate electrode of the first transistor T1*a* of the first pixel 101*a*, a sensing current corresponding to the first data signal VData1 can flow through the first transistor T1*a*, in the direction from the first electrode to the second electrode. Here, the sensing initialization voltage VPRES may have a voltage level lower than the threshold voltage of the organic light-emitting diode OLEDa. Consequently, the organic light-emitting diode OLEDa may not generate light.

In the first read time Tss1, the second switch SW1*b* may be turned off, while the eighth switch SW4*b* may be turned on. The fifth switch SW3*a* may remain turned on. When the second switch SW1*b* is turned off, the sensing initialization voltage VPRES may not be further transferred through the second data line DL2. Since the eighth switch SW4*b* remains turned on, the sample/hold circuit 122 may be connected to the second data line DL2. Consequently, in the first read time Tss1, the sample/hold circuit 122 can receive the voltage of the second node N2*a* via the third transistor T3*a*, the second data line DL2, and the eighth switch SW4*b*.

In the second sensing time TS2, a second gate signal g2 may be transferred through the second gate line GL2. In the second write time Tsr2 of the second sensing time TS2, a first voltage selection signal SPRE1 may be transferred as a turn-on signal ON. A second mode selection signal DSEL2 may be transferred as a turn-on signal ON. In addition, in the second read time Tss2, a third mode selection signal SSEL1 may be transferred as a turn-on signal ON. Thus, in the second sensing time TS2, the second transistor T2*b* and the third transistor T3*b* of the second pixel 101*b* may be turned on by the second gate signal g2, and the sixth switch SW3*b* may be turned on by the second mode selection signal DSEL2. In addition, in the second write time Tsr2 of the second sensing time TS2, the first switch SW1*a* may be turned on by the first voltage selection signal SPRE1. In the second read time Tss2 of the second sensing time TS2, the seventh switch SW4*a* may be turned on by the third mode selection signal SSEL1.

Consequently, in the second sensing time TS2, the second data signal Vdata2 may be transferred through the second data line DL2, and the sensing initialization voltage VPRES may be transferred through the first data line DL1. In addition, in the second write time Tsr2 of the second sensing time TS2, the sensing initialization voltage VPRES may be transferred through the first data line DL1. Consequently, the sensing initialization voltage VPRES can be transferred to the second node N2*b*, only in the second write time Tsr2.

In the second write time Tsr2, when the second data signal Vdata2 is transferred to the gate electrode of the first transistor T1*b* of the second pixel 101*b*, a sensing current corresponding to the second data signal Vdata2 can flow through the first transistor T1*b*, in the direction from the first electrode to the second electrode. Here, the sensing initialization voltage VPRES may have a voltage level lower than the threshold voltage of the organic light-emitting diode OLEDb. Accordingly, the organic light-emitting diode OLEDb may not generate light.

In the second read time Tss2, the first switch SW1*a* may be turned off, and the seventh switch SW4*a* may be turned on. The sixth switch SW3*b* may remain turned on. When the first switch SW1*a* is turned off, the sensing initialization voltage VPRES may not be further transferred through the first data line DLL Since the seventh switch SW4*a* remains turned on, the sample/hold circuit 122 may be connected to the first data line DLL Consequently, in the second read time Tss2, the sample/hold circuit 122 can receive the voltage of the second node N2*b* of the second pixel 101*b* via the third transistor T3*b*, first data line DL1, and the seventh switch SW4*a*.

In the third sensing time TS3, a first gate signal g1 may be transferred through the first gate line GL1. In addition, in the third write time Tsr3 of the third sensing time TS3, the second voltage selection signal SPRE2 may be transferred as a turn-on signal ON. The first mode selection signal DSEL1 may be transferred as a turn-on signal ON. In the third read time Tss3, a sixth mode selection signal SSEL4 may be transferred as a turn-on signal ON. Thus, in the third sensing time TS3, the second transistor T2*c* and the third transistor T3*c* of the third pixel 101*c* are turned on by the first gate signal g1, and the thirteenth switch SW3*c* may be turned on by the first mode selection signal DSEL1. In addition, the tenth switch SW1*d* may be turned on by the second voltage selection signal SPRE2 in the third write time Tsr3 of the third sensing time TS3, and the sixteenth switch SW4*d* may be turned on by the sixth mode selection signal SSEL4 in the third read time Tss3 of the third sensing time TS3.

Thus, a third data signal Vdata3 may be transferred through the third data line DL3 in the third sensing time TS3, and a sensing initialization voltage VPRES may be transferred through the fourth data line DL4. Consequently, the sensing initialization voltage VPRES may be transferred to the second node N2*c* in the third write time Tsr3.

In the third write time Tsr3, when the third data signal Vdata3 is transferred to the gate electrode of the first transistor T1*c* of the third pixel 101*c*, a sensing current corresponding to the third data signal Vdata3 can flow through the first transistor T1*c*, in the direction from the first electrode to the second electrode. Here, the sensing initialization voltage VPRES may have a voltage level lower than the threshold voltage of the organic light-emitting diode OLEDc. Consequently, the organic light-emitting diode OLEDc may not generate light.

In the third read time Tss3, the tenth switch SW1*d* may be turned off, and the sixteenth switch SW4*d* may be turned on. The thirteenth switch SW3*c* may remain turned on. When the tenth switch SW1*d* is turned off, the sensing initialization voltage VPRES may not be further transferred through the fourth data line DL4. Since the sixteenth switch SW4*d* remains turned on, the sample/hold circuit 122 may be connected to the fourth data line DL4. Consequently, in the third read time Tss3, the sample/hold circuit 122 can receive the voltage of the second node N2*c* of the third pixel 101*c* via the third transistor T3*c*, the fourth data line DL4, and the sixteenth switch SW4*d*.

In the fourth sensing time TS4, the second gate signal g2 may be transferred through the second gate line GL2. In addition, in the fourth write time Tsr4 of the fourth sensing time TS4, the first voltage selection signal SPRE1 may be transferred as a turn-on signal ON. The second mode selection signal DSEL2 may be transferred as a turn-on signal ON. In the second read time Tss2, a fifth mode selection signal SSEL3 may be transferred as a turn-on signal ON. Thus, in the fourth sensing time TS4, the second transistor T2*d* and the third transistor T3*d* of the fourth pixel 101*d* may be turned on by the second gate signal g2. In addition, in the fourth write time Tsr4 of the fourth sensing time TS4, the ninth switch SW1*c* may be turned on by the first voltage selection signal SPRE1. In the fourth read time Tss4 of the fourth sensing time TS4, the fifteenth switch SW4*c* may be turned on by the fifth mode selection signal SSEL3.

Thus, in the fourth sensing time TS4, a fourth data signal Vdata4 may be transferred through the fourth data line DL4, and a sensing initialization voltage VPRES may be transferred through the third data line DL3. Consequently, in the fourth write time Tsr4, the sensing initialization voltage VPRES may be transferred to the second node N2*d*.

In the fourth write time Tsr4, when the fourth data signal Vdata4 is transferred to the gate electrode of the first transistor T1*d* of the fourth pixel 101*d*, a sensing current corresponding to the fourth data signal Vdata4 can flow through the first transistor T1*d*, in the direction from the first electrode to the second electrode. Here, the sensing initialization voltage VPRES may have a voltage level lower than the threshold voltage of the organic light-emitting diode OLEDd. Consequently, the organic light-emitting diode OLEDd may not generate light.

In the fourth read time Tss4, the ninth switch SW1*c* may be turned off, and the fifteenth switch SW4*c* may be turned on. The fourteenth switch SW3*d* may remain turned on. When the ninth switch SW1*c* is turned off, the sensing initialization voltage VPRES may not be further transferred through the third data line DL3. Since the fifteenth switch SW4*c* remains turned on, the sample/hold circuit 122 may be connected to the third data lien DL3. Consequently, in the fourth read time Tss4, the sample/hold circuit 122 can receive the voltage of the second node N2*d* via the third transistor T3*d*, the third data line DL3, and the fifteenth switch SW4*c*.

As set forth above, data signal voltages and an initialization voltage may be transferred to and sensing voltages may be obtained from the first to fourth pixels 101*a* to 101*d* via the first to fourth data lines DL1 to DL4. Thus, the second voltage lines VL2 may be unnecessary, and the sensing lines Sense1 and Sense2 transferring the sensing signals are not required, unlike the case of FIG. 3 in which the initialization voltage is transferred and sensing voltages are obtained via the second voltage lines VL2. Accordingly, it is possible to reduce the number of electrical lines disposed on the display panel 110. When the data driver 120 senses a voltage through the second voltage line, the data driver 120 is required to have channels connected to the second voltage lines, in addition to the channels connected to the data lines. In the display panel 110 including the pixels configured as illustrated in FIG. 9, the second and third transistors are connected to a same gate line, and the sensing lines Sense1 and Sense2 transferring the sensing signals are not required, thereby making it possible to reduce the number of the channels of the gate driver 130. Accordingly, it is possible to reduce fabrication costs of the gate driver 130, thereby reducing fabrication costs of the organic light-emitting display device.

The foregoing descriptions and the accompanying drawings have been presented in order to explain the certain principles of the present disclosure. A person skilled in the art to which the present disclosure relates could make various modifications and variations by combining, dividing, substituting for, or changing the elements without departing from the principle of the present disclosure. The foregoing embodiments disclosed herein shall be interpreted as being illustrative, while not being limitative, of the principle and scope of the present disclosure. It should be understood that the scope of the present disclosure shall be defined by the appended Claims and all of their equivalents fall within the scope of the present disclosure.

What is claimed is:

1. A data driver, comprising:

a first amplifier supplying a data signal;

a sample/hold circuit receiving a sensing voltage;

a first switch circuit selectively connecting a driving initialization voltage or a sensing initialization voltage to a first data line or a second data line; and a second switch circuit selectively connecting the first amplifier to the first data line or the second data line and selectively connecting the sample/hold circuit to the first data line or the second data line, wherein when the first switch circuit connects the driving initialization voltage to the first data line, the second switch circuit connects the first amplifier to the second data line, and when the first switch circuit connects the driving initialization voltage to the second data line, the second switch circuit connects the first amplifier to the first data line.

2. The data driver of claim 1, wherein, when the first switch circuit connects the sensing initialization voltage to the first data line, the second switch circuit connects the first amplifier to the second data line, and when the first switch circuit connects the sensing initialization voltage to the second data line, the second switch circuit connects the first amplifier to the first data line.

3. The data driver of claim 2, wherein, when the second switch circuit connects the sample/hold circuit to the first data line, the second switch circuit connects the first amplifier to the second data line, and when the second switch circuit connects the sample/hold circuit to the second data line, the second switch circuit connects the first amplifier to the first data line.

4. The data driver of claim 3, wherein the second switch circuit connects the sample/hold circuit to the first data line, after the first switch circuit connects the sensing initialization voltage to the first data line, and wherein the second switch circuit connects the sample/hold circuit to the second data line, after the first switch circuit connects the sensing initialization voltage to the second data line.

5. The data driver of claim 1, wherein the first switch circuit connects the driving initialization voltage, which varies according to the sensing voltage received by the sample/hold circuit from the first data line, to the first data line, and wherein the first switch circuit connects the driving initialization voltage, which varies according to the sensing voltage received by the sample/hold circuit from the second data line, to the second data line.

6. The data driver of claim 1, further comprising:

a second amplifier supplying a data signal;

a third switch circuit selectively connecting the driving initialization voltage or the sensing initialization voltage to a third data line or a fourth data line; and a fourth switch circuit selectively connecting the second amplifier to the third data line or the fourth data line and selectively connecting the sample/hold circuit to the third data line or the fourth data line.

7. The data driver of claim 6, wherein, when the second switch circuit connects the first amplifier to one of the first data line and the second data line to apply a black data voltage through one of the first data line and the second data line, the first switch circuit connects the sensing initialization voltage to other one of the first data line and the second data line, and when the fourth switch circuit connects the second amplifier to one of the third data line and the fourth data line to apply the black data voltage through one of the third data line and the fourth data line, the third switch circuit connects the sensing initialization voltage to other one of the third data line and the fourth data line.

8. A data driver, comprising:

a first amplifier supplying a data signal through a first data line in a first sensing time, and supplying a data signal through a second data line in a second sensing time; and a sample/hold circuit receiving a sensing voltage through the second data line in the first sensing time and receiving a sensing voltage through the first data line in the second sensing time, wherein the first amplifier supplies a data signal through the first data line in a first driving time, and supplies a data signal through the second data line in a second driving time, and wherein the second data line is connected to a driving initialization voltage in the first driving time, and the first data line is connected to the driving initialization voltage in the second driving time.

9. The data driver of claim 8, wherein the second data line is connected to a sensing initialization voltage, before the sample/hold circuit receives the sensing voltage through the second data line, in the first sensing time, and wherein the first data line is connected to the sensing initialization voltage, before the sample/hold circuit receives the sensing voltage through the first data line, in the second sensing time.

10. The data driver of claim 8, further comprising:

a second amplifier supplying a data signal through a third data line in a third sensing time, and supplying a data signal through a fourth data line in a fourth sensing time, wherein the sample/hold circuit receives a sensing voltage through the fourth data line in the third sensing time and receiving a sensing voltage through the third data line in the fourth sensing time.

11. The data driver of claim 10, wherein the first amplifier supplies a black data voltage through the first data line in the third sensing time, and supplies the black data voltage through the second data line in the fourth sensing time, and wherein the second amplifier supplies the black data voltage through the third data line in the first sensing time and supplies the black data voltage through the fourth data line in the second sensing time.

12. The data driver of claim 8, wherein the second data line is connected to the driving initialization voltage, which varies according to the sensing voltage received by the sample/hold circuit through the first data line, in the first driving time, and wherein the first data line is connected to the driving initialization voltage, which varies according to the sensing voltage received by the sample/hold circuit through the second data line, in the second driving time.

13. An organic light-emitting display device, comprising:

a first data line supplying a data signal to a first pixel and supplying an initialization voltage to a second pixel;

a second data line supplying a data signal to the second pixel and supplying the initialization voltage to the first pixel;

a first gate line supplying a first gate signal to the first pixel; and a second gate line supplying a second gate signal to the second pixel, wherein the first data line and the second data line are adjacently disposed between the first pixel and the second pixel.

14. The organic light-emitting display device of claim 13, wherein the first pixel comprises:

a first transistor supplying a driving current to an organic light-emitting diode in the first pixel;

a second transistor turned on by the first gate signal and connected between a gate electrode of the first transistor and the first data line; and a third transistor turned on by the first gate signal and connected between an electrode of the first transistor, which outputs the driving current, and the second data line.

15. The organic light-emitting display device of claim 13, wherein the second pixel comprises:

a first transistor supplying a driving current to an organic light-emitting diode in the second pixel;

a second transistor turned on by the second gate signal and connected between a gate electrode of the first transistor and the second data line; and a third transistor turned on by the second gate signal and connected between an electrode of the first transistor, which outputs the driving current, and the first data line.

16. The organic light-emitting display device of claim 13, wherein the first data line supplies the data signal to the first pixel in a first driving time, and supplies the initialization voltage to the second pixel in a second driving time, and wherein the first data line supplies the data signal to the first pixel in a first sensing time, and supplies the initialization voltage to the second pixel and receives a sensing voltage from the second pixel in a second sensing time.

17. The organic light-emitting display device of claim 16, wherein a second transistor and a third transistor of the first pixel are turned on by the first gate signal, in the first driving time and the first sensing time.

18. The organic light-emitting display device of claim 16, wherein the second data line supplies the data signal to the second pixel in the second driving time, and supplies the initialization voltage to the first pixel in the first driving time, and wherein the second data line supplies the data signal to the second pixel in the second sensing time, and supplies the initialization voltage to the first pixel and receives a sensing voltage from the first pixel in the first sensing time.

19. The organic light-emitting display device of claim 18, wherein a second transistor and a third transistor of the second pixel are turned on by the second gate signal, in the second driving time and the second sensing time.

20. The organic light-emitting display device of claim 18, further comprising:

a third data line supplying a data signal to a third pixel and supplying the initialization voltage to a fourth pixel; and a fourth data line supplying a data signal to the fourth pixel and supplying the initialization voltage to the third pixel;

wherein the first gate line supplies the first gate signal to the third pixel, and wherein the second gate line supplies the second gate signal to the fourth pixel.

21. The organic light-emitting display device of claim 20, wherein the third data line supplies a black data voltage to the third pixel in the first sensing time, and the fourth data line supplies the black data voltage to the fourth pixel in the second sensing time.

22. The organic light-emitting display device of claim 18, wherein the second data line supplies the initialization voltage, which varies according to the sensing voltage received from the first pixel by the second data line, to the first pixel in the first driving time, and wherein the first data line supplies the initialization voltage, which varies according to the sensing voltage received from the second pixel by the first data line, to the second pixel in the second driving time.

* * * * *